US008627793B2

(12) United States Patent
Takada

(10) Patent No.: US 8,627,793 B2
(45) Date of Patent: Jan. 14, 2014

(54) CONTROL VALVE FOR USE IN VALVE TIMING CONTROL APPARATUS

(75) Inventor: Yasuhide Takada, Atsugi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 99 days.

(21) Appl. No.: 13/443,942

(22) Filed: Apr. 11, 2012

(65) Prior Publication Data

US 2013/0008397 A1 Jan. 10, 2013

(30) Foreign Application Priority Data

Jul. 8, 2011 (JP) ..... 2011-151320

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

2006/0130789 A1* 6/2006 Smith ..... 123/90.17

FOREIGN PATENT DOCUMENTS

JP 2003-247403 9/2003

* cited by examiner

*Primary Examiner* — Zelalem Eshete
(74) *Attorney, Agent, or Firm* — Antonelli, Terry, Stout & Kraus, LLP.

(57) ABSTRACT

A directional control valve is configured to switch among a first position at which a discharge passage communicates with a phase-advance passage and a phase-retard passage and a lock passage communicates with a drain passage, a second position at which the discharge passage communicates with the phase-advance passage and the lock passage and the phase-retard passage communicates with the drain passage, a third position at which the discharge passage communicates with the phase-retard passage and the lock passage and the phase-advance passage communicates with the drain passage, and a fourth position at which the discharge passage communicates with the lock passage and fluid-communication between the discharge passage and each of the phase-advance passage and the phase-retard passage is blocked. The directional control valve is further switchable to a sixth position at which the phase-advance passage, the phase-retard passage, and the lock passage all communicate with the discharge passage.

19 Claims, 20 Drawing Sheets

CONTROL VALVE FOR USE IN VALVE TIMING CONTROL APPARATUS

TECHNICAL FIELD

The present invention relates to a control valve for use in a valve timing control apparatus configured to variably control valve timing of an engine valve, such as an intake valve and/or an exhaust valve, depending on an engine operating condition.

BACKGROUND ART

In recent years, there have been proposed and developed various hydraulically-operated vane member equipped variable valve timing control devices, capable of locking a vane member at an intermediate position between a maximum phase-advance position and a maximum phase-retard position by means of a lock mechanism during a starting period of an internal combustion engine. To release a locked state of the vane member with a lock pin of the lock mechanism engaged, working fluid (hydraulic oil) in either a phase-advance chamber or a phase-retard chamber is used. During rotation of a camshaft, owing to reaction forces from the engine valve side to cams, a so-called alternating torque (in other words, positive and negative torque fluctuations) acts on the camshaft. Owing to alternating torque transmitted from the camshaft, the vane member tends to flutter, and thus hydraulic-pressure fluctuations in the phase-retard chamber and the phase-advance chamber occur. Owing to such hydraulic-pressure fluctuations, arising from alternating torque, there is a possibility that the locked state cannot be easily released.

To avoid this, Japanese Patent Provisional Publication No. 2003-247403 (hereinafter is referred to as "JP2003-247403") teaches that an exclusive oil passage, only used for the lock mechanism, is provided separately from supply-and-exhaust oil passages for phase-advance chambers and phase-retard chambers, and a single control valve is also provided for working-fluid supply-and-exhaust control for phase-advance chambers and phase-retard chambers and for hydraulic-pressure control for the lock mechanism for locking or unlocking.

SUMMARY OF THE INVENTION

However, in the case of the valve timing control device disclosed in JP2003-247403, employing an exclusive oil passage for the lock mechanism, when, with a lock pin engaged, a locked state of the vane member is released, hydraulic pressure is supplied to each of the phase-advance chambers, while working fluid in each of the phase-retard chambers is exhausted. Hence, movement of the lock pin in the unlocking direction (or in the disengaging direction) occurs under a condition where rotary motion of the vane member in the phase-advance direction takes place. A shearing force acts on the lock pin at the edge of the inner periphery of a lock-pin hole, and thus the outer periphery of the lock pin is in a condition of being in press-contact with the edge of the inner periphery of the lock-pin hole. In such a case, there is a possibility that the locked state cannot be easily released.

Therefore, it would be desirable to easily certainly achieve unlocking action of the lock mechanism regardless of hydraulic-pressure fluctuations, arising from alternating torque.

It is, therefore, in view of the previously-described disadvantages of the prior art, an object of the invention to provide a control valve for use in a valve timing control apparatus, capable of easily certainly achieve unlocking action of a lock mechanism (a position-hold mechanism) configured to lock or hold a vane member at an intermediate position between a maximum phase-advance position and a maximum phase-retard position.

In order to accomplish the aforementioned and other objects of the present invention, a control valve for use in a valve timing control apparatus having a housing adapted to be driven by a crankshaft of an internal combustion engine and configured to define a working fluid chamber therein, a vane rotor fixedly connected to a camshaft and rotatably accommodated in the housing so that the vane rotor rotates relative to the housing, the vane rotor having vanes configured to partition the working fluid chamber into a phase-advance chamber and a phase-retard chamber, a lock mechanism configured to be locked to enable the vane rotor to be held at an intermediate position between a maximum phase-advance position and a maximum phase-retard position, and configured to be unlocked by a working fluid pressure supplied thereto, a phase-advance passage configured to communicate with the phase-advance chamber, a phase-retard passage configured to communicate with the phase-retard chamber, and a lock passage provided for working-fluid-pressure supply-and-exhaust for the lock mechanism, comprises a directional control valve configured to be switchable among a first position, a second position, a third position, and a fourth position, the first position being a position at which a discharge passage of a pump driven by the engine communicates with both the phase-advance passage and the phase-retard passage and simultaneously the lock passage communicates with a drain passage, the second position being a position at which the discharge passage communicates with both the phase-advance passage and the lock passage and simultaneously the phase-retard passage communicates with the drain passage, the third position being a position at which the discharge passage communicates with both the phase-retard passage and the lock passage and simultaneously the phase-advance passage communicates with the drain passage, and the fourth position being a position at which the discharge passage communicates with the lock passage and simultaneously the discharge passage communicates with both the phase-advance passage and the phase-retard passage through a flow passage area less than a given flow passage area obtained at the first position or fluid-communication between the discharge passage and each of the phase-advance passage and the phase-retard passage is blocked.

According to another aspect of the invention, a control valve for use in a valve timing control apparatus having a driving rotary member adapted to be driven by a crankshaft of an internal combustion engine, a driven rotary member fixedly connected to a camshaft and configured to define a phase-advance chamber and a phase-retard chamber between the driving rotary member and the driven rotary member, a lock mechanism configured to be locked to enable an angular position of the driven rotary member relative to the driving rotary member to be held at an intermediate position between a maximum phase-advance position and a maximum phase-retard position, and configured to be unlocked by a working fluid pressure supplied thereto, a phase-advance passage configured to communicate with the phase-advance chamber, a phase-retard passage configured to communicate with the phase-retard chamber, and a lock passage provided for working-fluid-pressure supply-and-exhaust for the lock mechanism, comprises a directional control valve configured to be switchable among a first position, a second position, a third position, and a fourth position, the first position being a position at which a discharge passage of a pump driven by the engine communicates with both the phase-advance passage and the phase-retard passage and simultaneously the lock passage communicates with a drain passage, the second position being a position at which the discharge passage communicates with both the phase-advance passage and the lock passage and simultaneously the phase-retard passage communicates with the drain passage, the third position being a position at which the discharge passage communicates with both the phase-retard passage and the lock passage and simultaneously the phase-advance passage communicates with the drain passage, and the fourth position being a position at which the discharge passage communicates with the lock passage and simultaneously the discharge passage communicates with both the phase-advance passage and the phase-retard passage through a flow passage area less than a given flow passage area obtained at the first position or fluid-communication between the discharge passage and each of the phase-advance passage and the phase-retard passage is blocked.

According to a further aspect of the invention, a controller for controlling a control valve for use in a valve timing control apparatus having a housing adapted to be driven by a crankshaft of an internal combustion engine and configured to define a working fluid chamber therein, a vane rotor fixedly connected to a camshaft and rotatably accommodated in the housing so that the vane rotor rotates relative to the housing, the vane rotor having vanes configured to partition the working fluid chamber into a phase-advance chamber and a phase-retard chamber, a lock mechanism configured to be locked to enable the vane rotor to be held at an intermediate position between a maximum phase-advance position and a maximum phase-retard position, and configured to be unlocked by a working fluid pressure supplied thereto, a phase-advance passage configured to communicate with the phase-advance chamber, a phase-retard passage configured to communicate with the phase-retard chamber, and a lock passage provided for working-fluid-pressure supply-and-exhaust for the lock mechanism, comprises an electronic control unit configured to control switching among a first position, a second position, a third position, and a fourth position by varying a level of energizing an electrically-actuated valve element of the control valve, the first position being a position at which a discharge passage of a pump driven by the engine communicates with both the phase-advance passage and the phase-retard passage and simultaneously the lock passage communicates with a drain passage, the second position being a position at which the discharge passage communicates with both the phase-advance passage and the lock passage and simultaneously the phase-retard passage communicates with the drain passage, the third position being a position at which the discharge passage communicates with both the phase-retard passage and the lock passage and simultaneously the phase-advance passage communicates with the drain passage, and the fourth position being a position at which the discharge passage communicates with the lock passage and simultaneously the discharge passage communicates with both the phase-advance passage and the phase-retard passage through a flow passage area less than a given flow passage area obtained at the first position or fluid-communication between the discharge passage and each of the phase-advance passage and the phase-retard passage is blocked, the control unit configured to switch a position of the control valve to the first position during a starting period of the engine, the control unit configured to selectively switch the position of the control valve to either one of the second and third positions, when varying valve timing of the engine, and the control unit configured to switch the position of the control valve to the fourth position, when holding the valve timing of the engine.

The other objects and features of this invention will become understood from the following description with reference to the accompanying drawings.

Figure 20A:
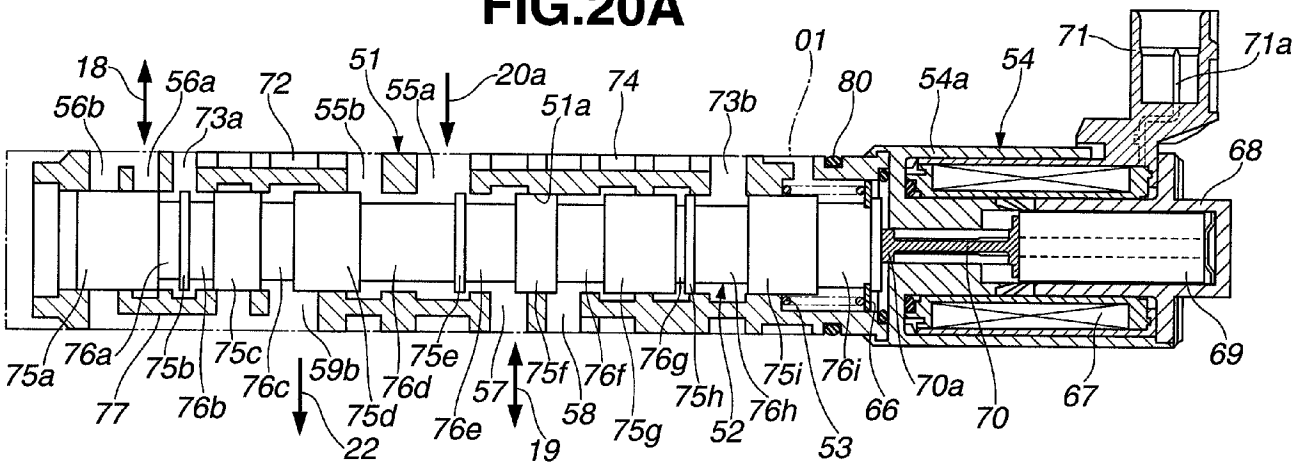
FIG. 20A is a longitudinal cross-sectional view of a second embodiment of an electromagnetic directional control valve, which can be applied to the VTC apparatus, whereas FIG.

20B is a longitudinal cross-sectional view of the electromagnetic directional control valve of the second embodiment at an angular position rotated 90 degrees from the angular position corresponding to the cross section of FIG. 20A.

Figure 21A:
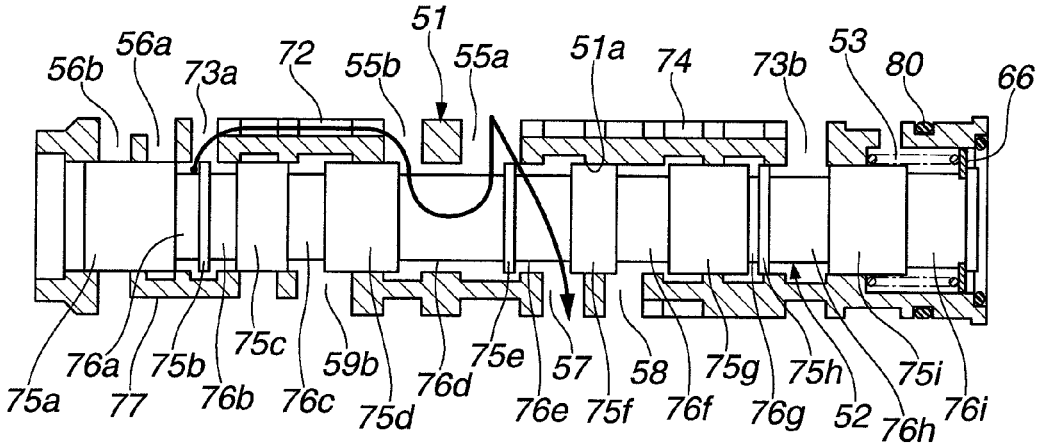
Figure 21B:
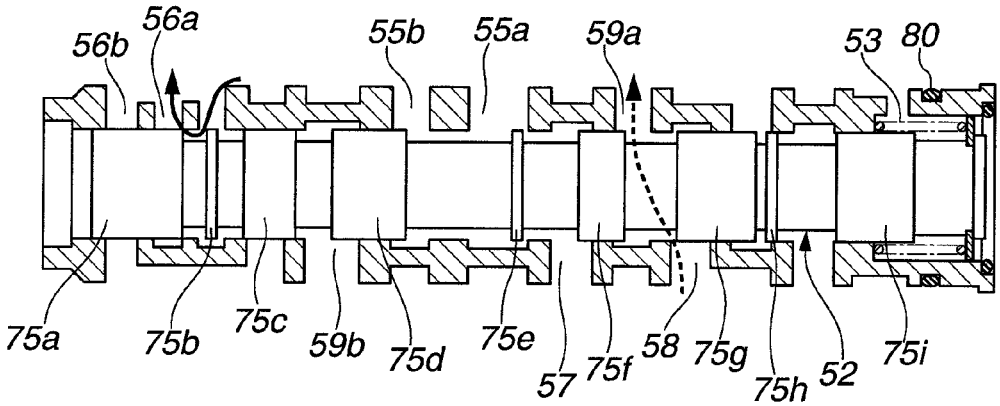

FIG. 21A is a longitudinal cross-sectional view of a valve spool of the electromagnetic directional control valve of the second embodiment, positioned in a first position, whereas FIG. 21B is a longitudinal cross-sectional view of the valve spool at an angular position rotated 90 degrees from the angular position corresponding to the cross section of FIG. 21A.

Figure 22A:
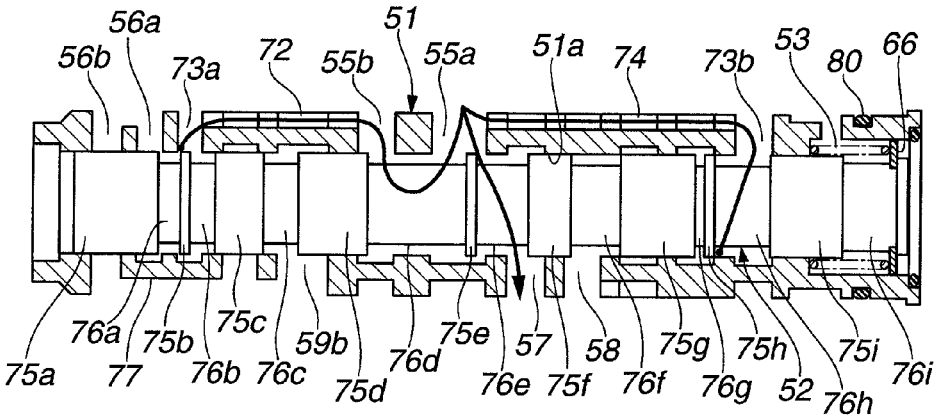
Figure 22B:
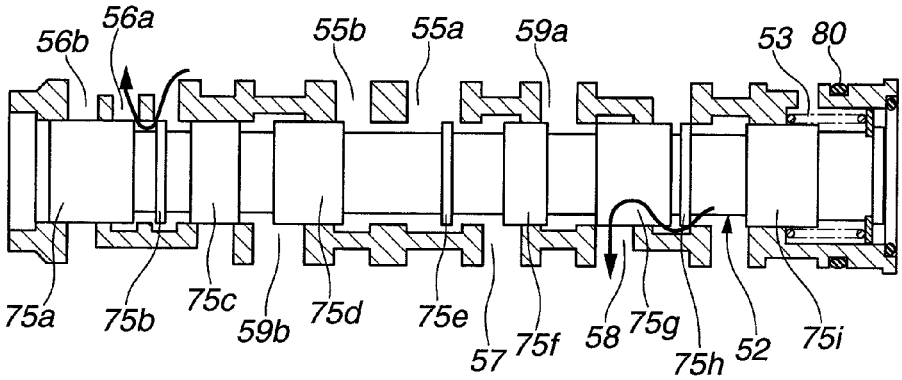

FIG. 22A is a longitudinal cross-sectional view of the valve spool of the electromagnetic directional control valve of the second embodiment, positioned in a sixth position, whereas FIG. 22B is a longitudinal cross-sectional view of the valve spool at an angular position rotated 90 degrees from the angular position corresponding to the cross section of FIG. 22A.

Figure 23A:
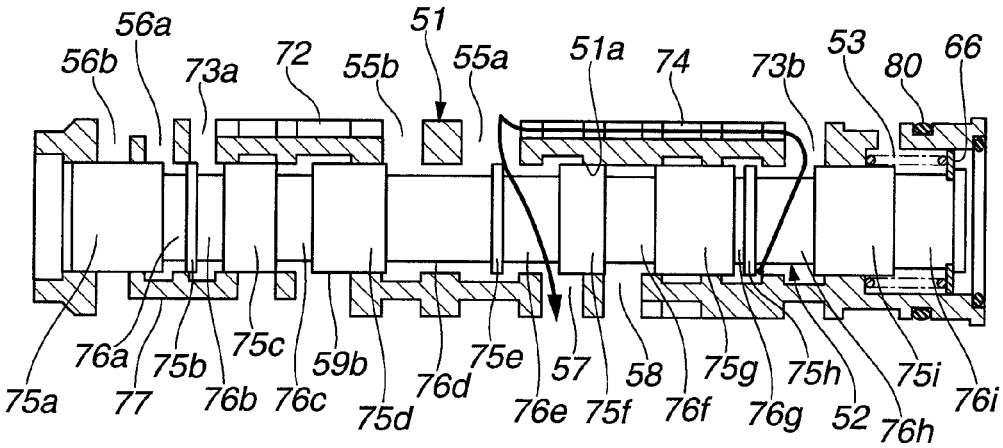
Figure 23B:
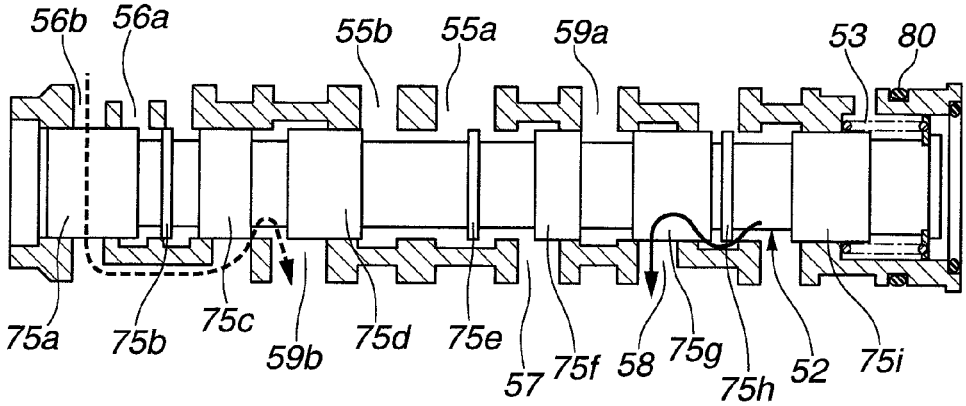

FIG. 23A is a longitudinal cross-sectional view of the valve spool of the electromagnetic directional control valve of the second embodiment, positioned in a second position, whereas FIG. 23B is a longitudinal cross-sectional view of the valve spool at an angular position rotated 90 degrees from the angular position corresponding to the cross section of FIG. 23A.

Figure 24A:
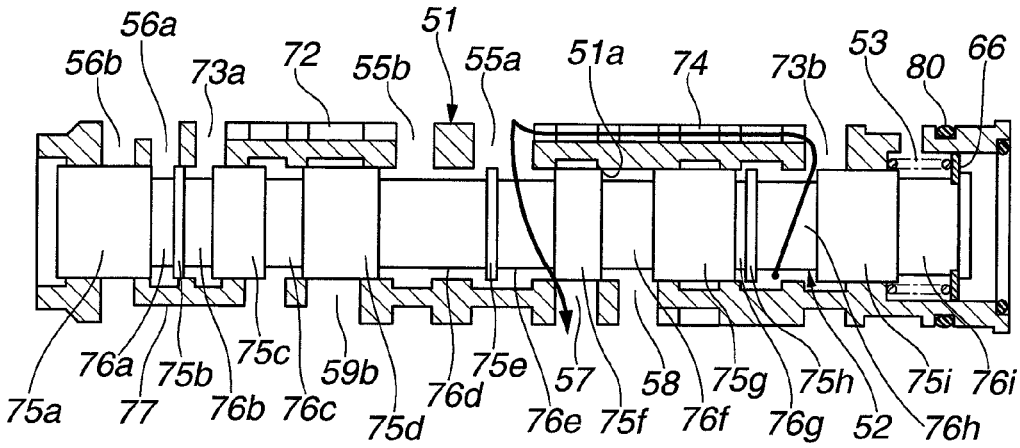
Figure 24B:
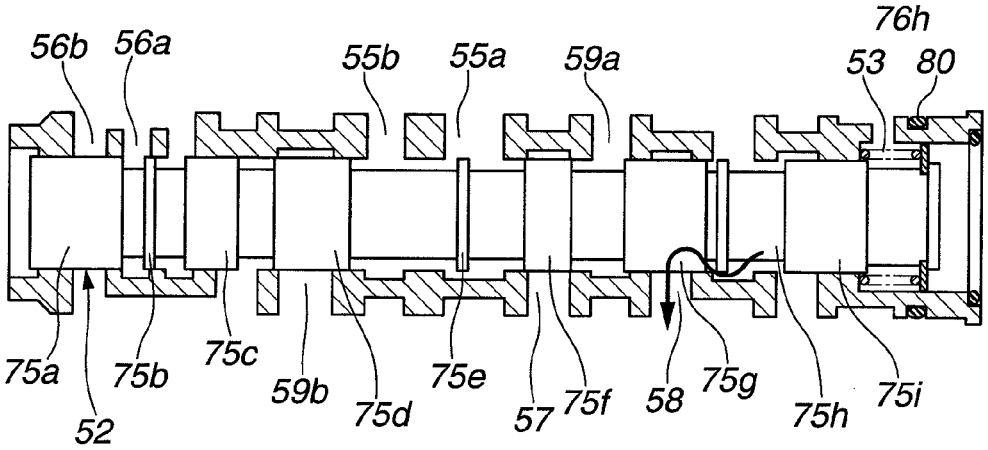

FIG. 24A is a longitudinal cross-sectional view of the valve spool of the electromagnetic directional control valve of the second embodiment, positioned in a fourth position, whereas FIG. 24B is a longitudinal cross-sectional view of the valve spool at an angular position rotated 90 degrees from the angular position corresponding to the cross section of FIG. 24A.

Figure 25A:
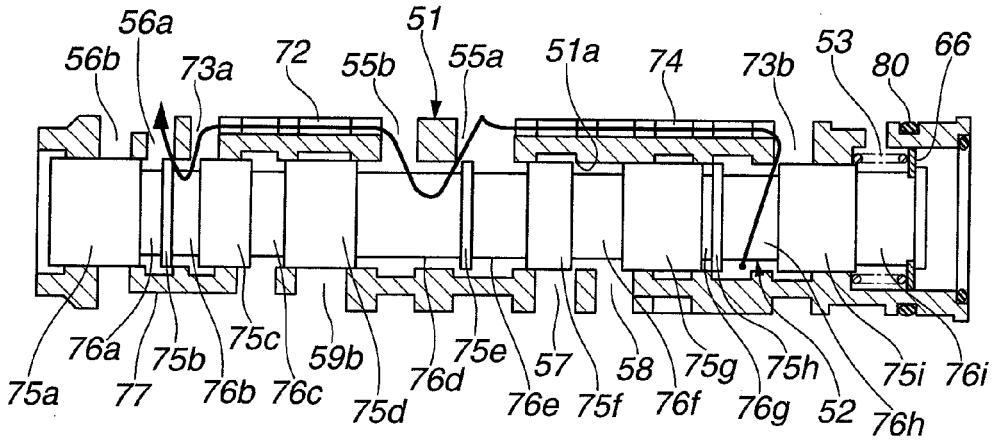
Figure 25B:
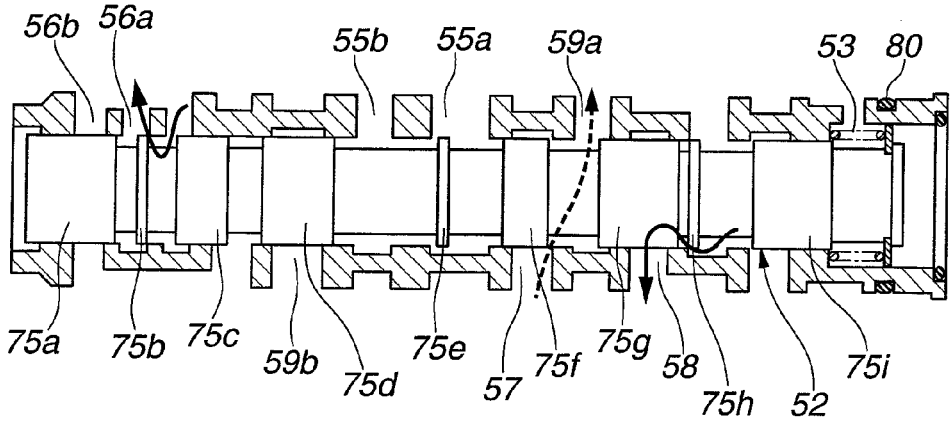

FIG. 25A is a longitudinal cross-sectional view of the valve spool of the electromagnetic directional control valve of the second embodiment, positioned in a third position, whereas FIG. 25B is a longitudinal cross-sectional view of the valve spool at an angular position rotated 90 degrees from the angular position corresponding to the cross section of FIG. 25A.

Figure 26A:
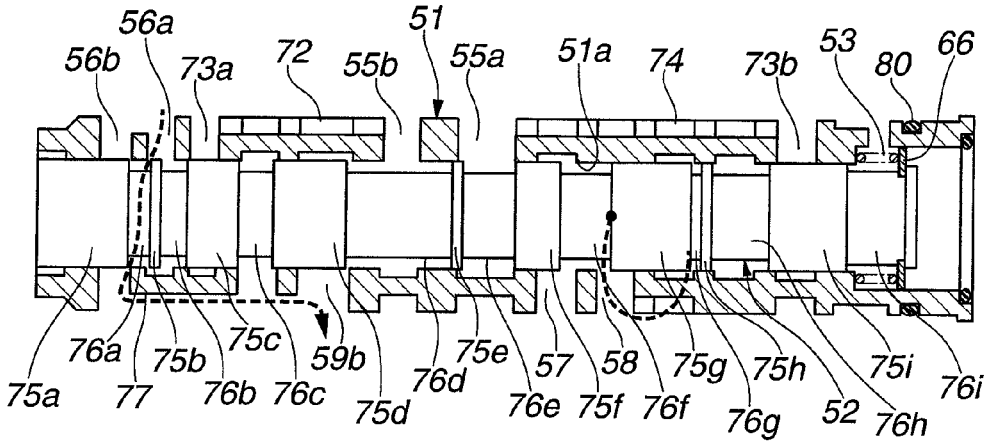
Figure 26B:
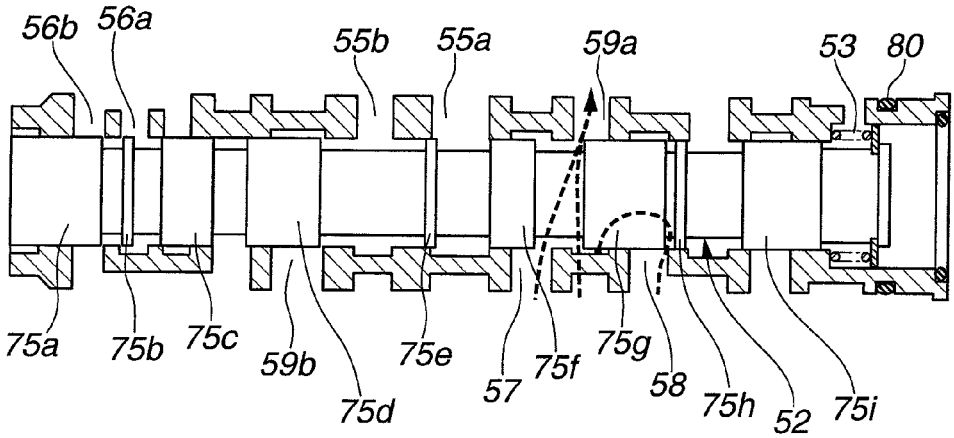

FIG. 26A is a longitudinal cross-sectional view of the valve spool of the electromagnetic directional control valve of the second embodiment, positioned in a fifth position, whereas FIG. 26B is a longitudinal cross-sectional view of the valve spool at an angular position rotated 90 degrees from the angular position corresponding to the cross section of FIG. 26A.

DESCRIPTION OF THE PREFERRED EMBODIMENTS

Referring now to the drawings, particularly to FIGS. 1-4, the control valve of the embodiment is exemplified in a valve timing control apparatus which is applied to an intake-valve side of an internal combustion engine of a hybrid electric vehicle (HEV), an idling-stop system equipped automotive vehicle, and the like.

As shown in FIGS. 1-4, the valve timing control apparatus includes a timing sprocket 1 driven by an engine crankshaft via a timing chain and serving as a driving rotary member, an intake-valve side camshaft 2 arranged in a longitudinal direction of the engine and configured to be relatively rotatable with the sprocket 1, a phase-change mechanism 3 installed between sprocket 1 and camshaft 2 to change a relative angular phase of camshaft 2 to sprocket 1 (the crankshaft), a position-hold mechanism 4 provided for locking or holding the phase-change mechanism 3 at a predetermined intermediate-phase angular position between a maximum phase-advance position and a maximum phase-retard position, and a hydraulic circuit 5 provided for hydraulically operating each of phase-change mechanism 3 and position-hold mechanism 4.

Sprocket 1 is formed into a thick-walled disc-shape. The outer periphery of sprocket 1 has a toothed portion 1*t* on which the timing chain is wound. The thick-walled disc-shaped sprocket 1 also serves as a rear cover hermetically covering a rear opening end of a housing (described later). Sprocket 1 is also formed with a supported bore 6 (a central through hole), which is rotatably supported on the outer periphery of a vane rotor (described later) fixedly connected to the camshaft 2.

Camshaft 2 is rotatably supported on a cylinder head (not shown) via cam bearings (not shown). Camshaft 2 has a plurality of cams integrally formed on its outer periphery and spaced apart from each other in the axial direction of camshaft 2, for operating engine valves (i.e., intake valves). Camshaft 2 has a female-screw threaded hole 2*a* formed along the camshaft center at one axial end.

Figure 1:
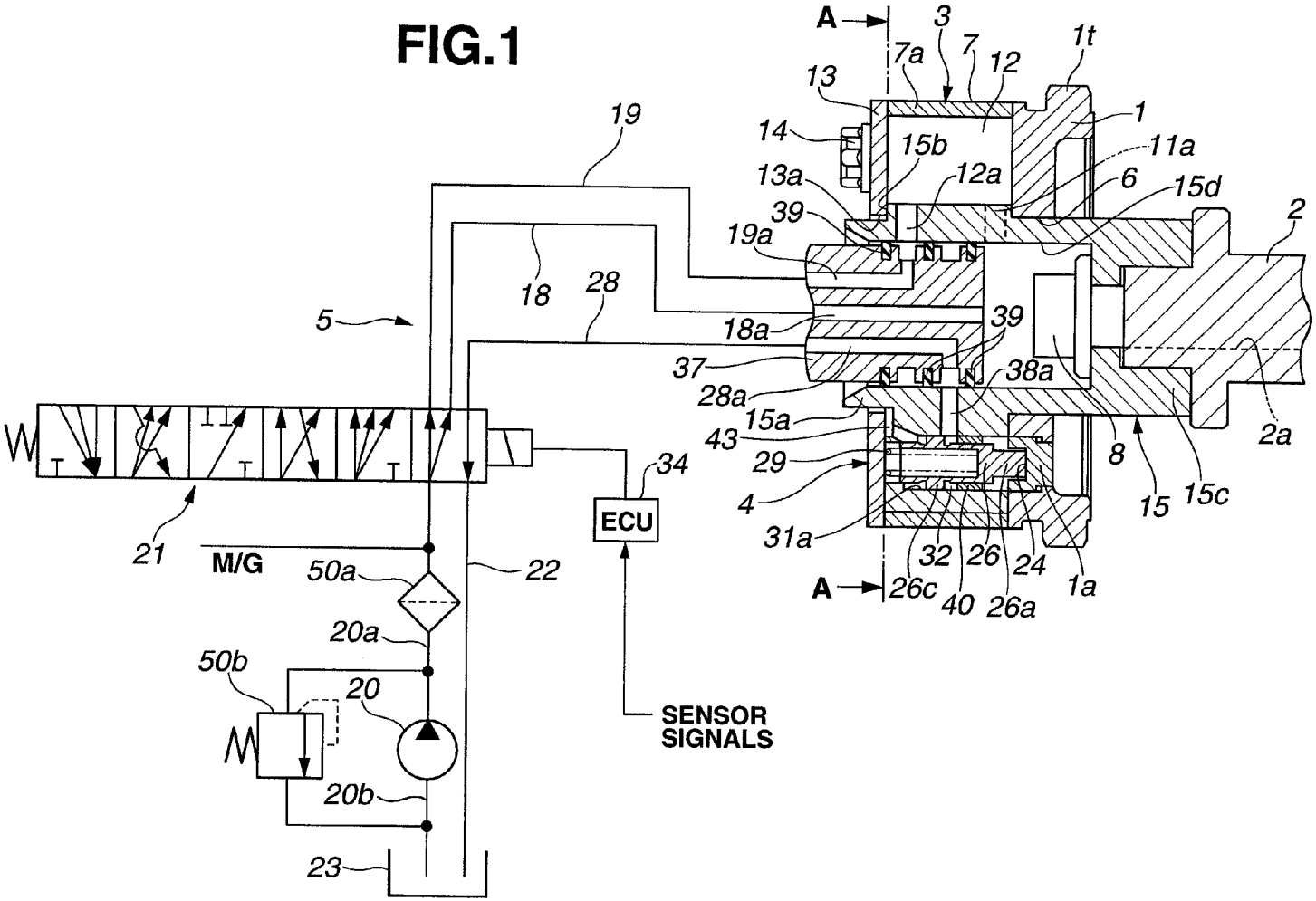
FIG. 1 is a system diagram illustrating a valve timing control (VTC) apparatus to which an embodiment of an electromagnetic directional control valve can be applied.
Figure 2:
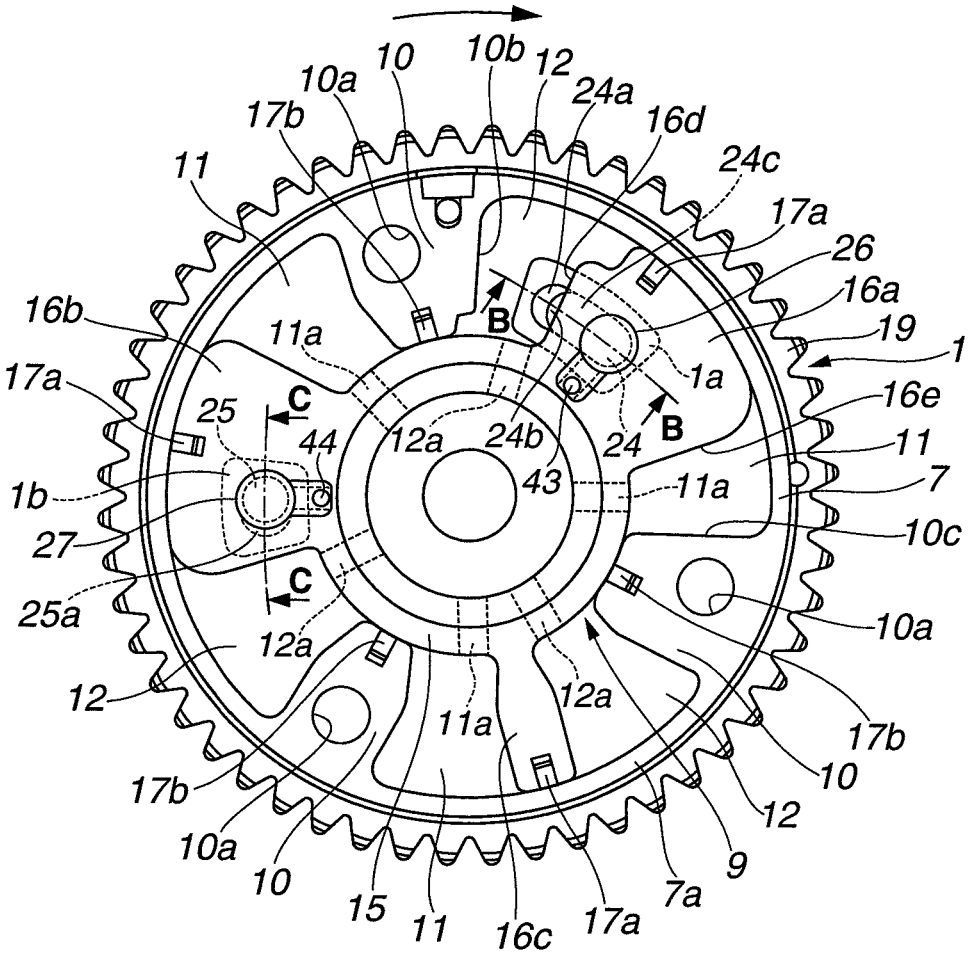
FIG. 2 is a cross-sectional view taken along the line A-A in FIG. 1 and showing an intermediate phase state where a vane member of the VTC apparatus is held at an angular position corresponding to an intermediate phase.

As shown in FIGS. 1-2, phase-change mechanism 3 is comprised of a housing 7, a vane member 9, three phase-retard hydraulic chambers (simply, three phase-retard chambers) 11, 11, 11 and three phase-advance hydraulic chambers (simply, three phase-advance chambers) 12, 12, 12. Housing 7 is integrally connected to the sprocket 1 in the axial direction. Vane member 9 is fixedly connected to the axial end of camshaft 2 by means of a cam bolt 8 screwed into the female screw-threaded hole 2*a* of the axial end of camshaft 2, and serves as a driven rotary member rotatably enclosed in the housing 7. Housing 7 has three partition walls 10, 10, 10 (three shoes) integrally formed on the inner peripheral surface of housing 7. Three phase-retard chambers 11 and three phase-advance chambers 12 are defined by three partition walls 10 and three vanes (described later) of vane member 9.

Housing 7 includes a cylindrical housing body 7*a*, a front cover 13, and the sprocket 1 serving as the rear cover for the rear opening end of housing 7. Housing body 7*a* is formed as a cylindrical hollow housing member, opened at both ends in the two opposite axial directions. Housing body 7*a* is made of sintered alloy materials, such as iron-based sintered alloy materials. Housing body 7*a* has three radially-inward protruded shoes 10, 10, 10 integrally formed on its inner periphery. Front cover 13 is produced by pressing. Front cover 13 is provided for hermetically covering the front opening end of housing body 7*a*. Housing body 7*a*, front cover 13, and sprocket 1 (i.e., the rear cover) are integrally connected to each other by fastening them together with three bolts 14, 14, 14, penetrating respective bolt insertion holes, namely, three through holes 10*a*, 10*a*, 10*a* formed in respective partition walls 10. Front cover 13 is formed with a central insertion hole 13*a* (a through hole).

Vane member 9 is formed of a metal material. Vane member 9 is comprised of a vane rotor 15 fixedly connected to the axial end of camshaft 2 by means of the cam bolt 8, and three radially-extending vane blades 16*a*, 16*b*, and 16*c*, formed on the outer periphery of vane rotor 15 and circumferentially spaced apart from each other by approximately 120 degrees.

Vane rotor 15 is formed into a substantially cylindrical-hollow shape, extending axially. Vane rotor 15 is integrally formed with a central cylindrical-hollow seal member insertion guide portion 15*a* slightly axially protruding from a front end face 15*b*. A rear end 15*c* of vane rotor 15 is configured to axially extend toward the camshaft 2. A cylindrical fitting bore 15*d* is formed in the vane rotor 15 over the axial length from the front end to the rear end of vane rotor 15.

Three vanes 16*a*-16*c* are disposed in respective internal spaces defined by three partition walls 10. Circumferential widths of three vanes 16*a*-16*c* are dimensioned to differ from each other. Vane 16*a* having a maximum circumferential width and vane 16*b* having a middle circumferential width slightly less than the maximum circumferential width are both formed into a substantially sector. On the other hand, vane 16*c* having a minimum circumferential width is formed into a thick-walled plate. Three vanes 16*a*-16*c* have respective axially-elongated seal retaining grooves, formed in their outermost ends (apexes) and extending in the axial direction. Each of three seal retaining grooves of the vanes is formed into a substantially rectangle. Three oil seal members (three apex seals) 17*a*, 17*a*, and 17*a*, each having a substantially square lateral cross section, are fitted into respective seal retaining grooves of three vanes 16*a*-16*c* to provide a sealing action between the inner peripheral surface of housing body 7*a* and the outermost ends (apexes) of vanes 16*a*-16*c*. In a similar manner, three partition walls 10 have respective axially-elongated seal retaining grooves, formed in their innermost ends (apexes) and extending in the axial direction. Each of three seal retaining grooves of the partition walls is formed into a substantially rectangle. Three oil seal members (three apex seals) 17*b*, 17*b*, and 17*b*, each having a substantially square lateral cross section, are fitted into respective seal retaining grooves of three partition walls 10 to provide a sealing action between the outer peripheral surface of vane rotor 15 and the innermost ends (apexes) of partition walls 10.

Figure 3:
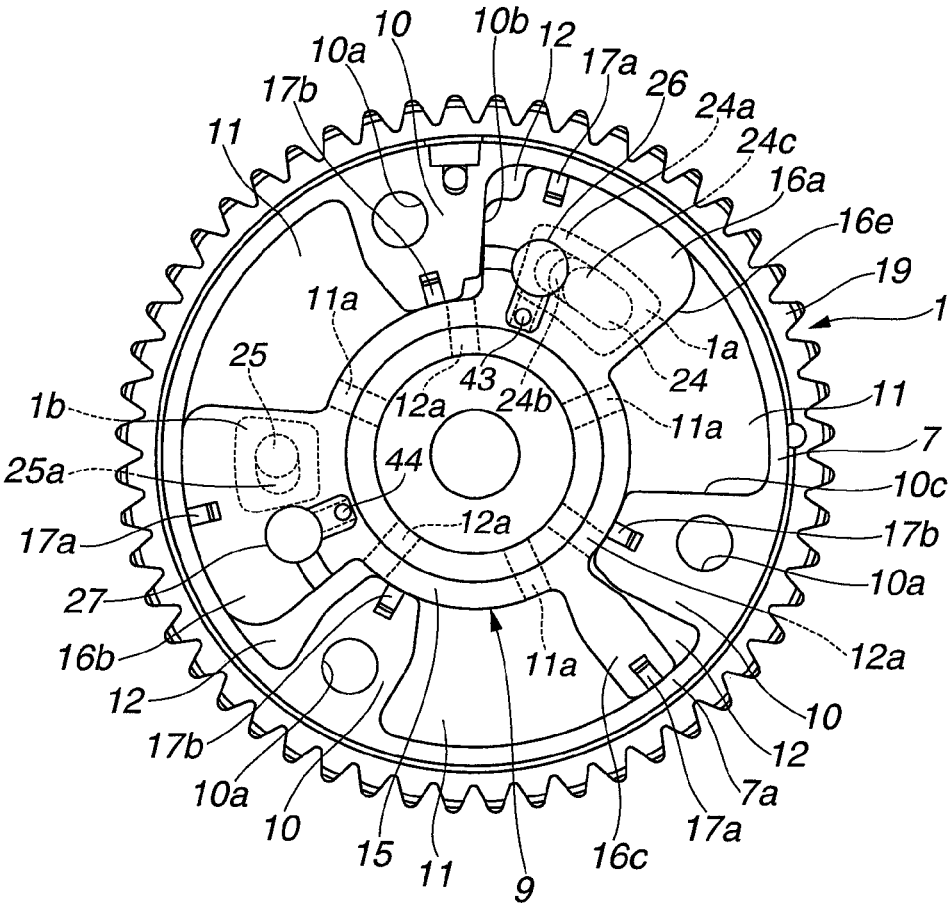
FIG. 3 is a cross-sectional view taken along the line A-A in FIG. 1 and showing a maximum phase-retard state where the vane member has been rotated to an angular position corresponding to a maximum retarded phase.

As shown in FIG. 3, when vane member 9 rotates relative to the housing 7 (or the sprocket 1) in the phase-retard direction, one side face 16*d* (an anticlockwise side face, viewing FIG. 3) of the maximum-circumferential-width vane 16*a* is brought into abutted-engagement with a radially-inward protruding surface 10*b* formed on one side face (a clockwise side face, viewing FIG. 3) of the opposed partition wall 10, and thus a maximum phase-retard angular position of vane member 9 is restricted. Conversely, as shown in FIG. 4, when vane member 9 rotates relative to the housing 7 (or the sprocket 1) in the phase-advance direction (see the direction of rotation indicated by the arrow in FIG. 2), the other side face 16*e* (a clockwise side face, viewing FIG. 4) of the maximum-circumferential-width vane 16*a* is brought into abutted-engagement with a radially-inward protruding surface 10*c* formed on one side face (an anticlockwise side face, viewing FIG. 4) of the opposed partition wall 10, and thus a maximum phase-advance angular position of vane member 9 is restricted.

With the maximum-circumferential-width vane 16*a* kept in its maximum phase-retard angular position (see FIG. 3) or with the maximum-circumferential-width vane 16*a* kept in its maximum phase-advance angular position (see FIG. 4), both side faces of each of the other vanes 16*b* and 16*c* are kept in a spaced, contact-free relationship with respective side faces of the associated partition walls. Hence, the accuracy of abutment between vane member 9 and partition wall 10 can be enhanced, and additionally the speed of hydraulic pressure supply to each of hydraulic chambers 11 and 12 can be increased, thus a responsiveness of normal-rotation/reverse-rotation of vane member 9 can be improved.

The previously-discussed three phase-retard chambers 11 and phase-advance chambers 12 are defined by both side faces of each of vanes 16*a*-16*c* and both side faces of each of partition walls 10. Each of phase-retard chambers 11 is configured to communicate with the hydraulic circuit 5 (described later) via the associated radially-extending first communication hole 11*a* formed in the vane rotor 15. In a similar manner, each of phase-advance chambers 12 is configured to communicate with the hydraulic circuit 5 via the associated radially-extending second communication hole 12*a* formed in the vane rotor 15.

Figure 4:
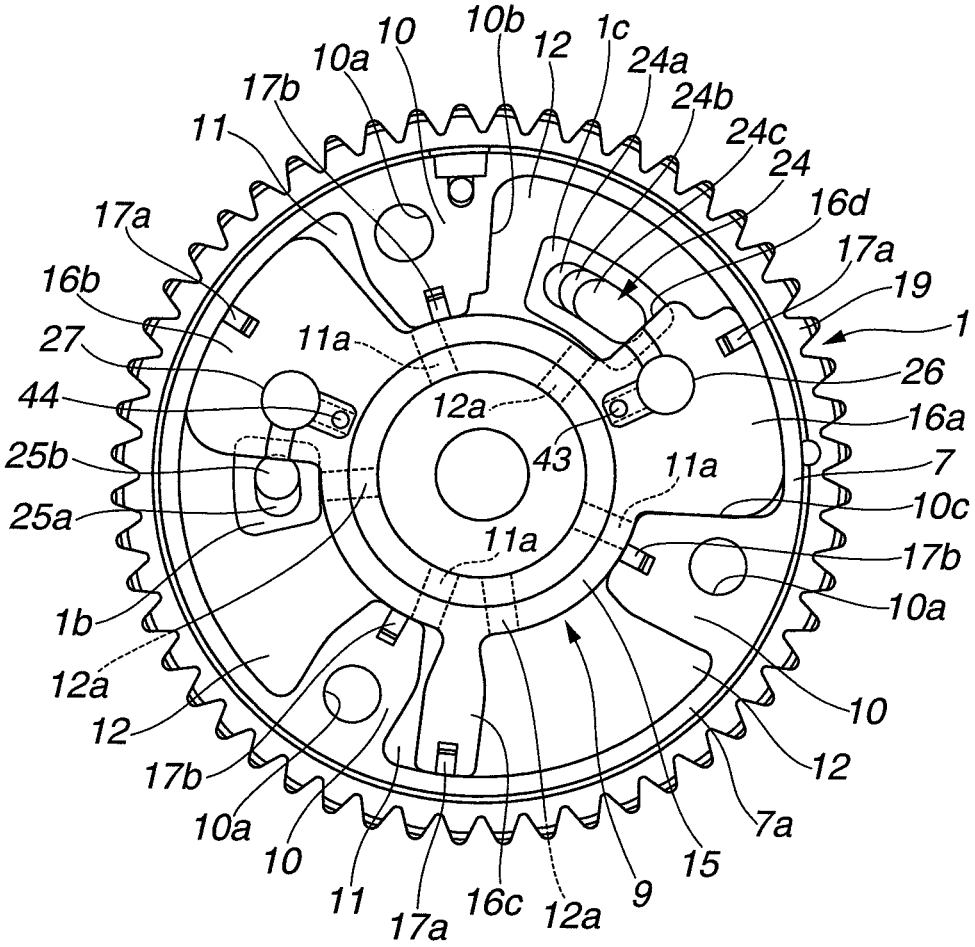
FIG. 4 is a cross-sectional view taken along the line A-A in FIG. 1 and showing a maximum phase-advance state where the vane member has been rotated to an angular position corresponding to a maximum advanced phase.

Position-hold mechanism 4 is provided for holding or locking an angular position of vane member 9 relative to housing 7 at an intermediate-phase angular position (corresponding to the angular position of vane member 9 in FIG. 2) between the maximum phase-retard angular position (see FIG. 3) and the maximum phase-advance angular position (see FIG. 4). That is, position-hold mechanism 4 serves as a lock mechanism.

As shown in FIGS. 5-10, position-hold mechanism 4 is comprised of a first lock-hole structural member 1*a*, a second lock-hole structural member 1*b*, a first lock hole 24, a second lock hole 25, a first lock pin 26, a second lock pin 27, and a lock-unlock passage (simply, a lock passage) 28. The first and second lock-hole structural members 1*a*-1*b* are disposed in the sidewall of sprocket 1, also serving as the rear cover for hermetically covering the rear opening end of housing body 7*a*, and arranged at respective given circumferential positions. As seen in FIGS. 5-10, each of first and second lock-hole structural members 1*a*-1*b* has a substantially T-shaped cross section. The first lock hole 24 is formed in the first lock-hole structural member 1*a*, whereas the second lock hole 25 is formed in the second lock-hole structural member 1*b*. The first lock pin 26 (serving as a substantially cylindrical locking member) is operably disposed in the maximum-circumferential-width vane 16*a* such that movement of first lock pin 26 into and out of engagement with the first lock hole 24 is permitted. In a similar manner, the second lock pin 27 (serving as a substantially cylindrical locking member) is operably disposed in the middle-circumferential-width vane 16*b* such that movement of second lock pin 27 into and out of engagement with the second lock hole 25 is permitted. Lock passage 28 is provided for disengagement of the first lock pin 26 from the first lock hole 24 and for disengagement of the second lock pin 27 from the second lock hole 25.

As seen in FIGS. 2-5, the first lock hole 24 is formed into a cocoon shape (or a circular-arc elliptic shape) extending in the circumferential direction of sprocket 1. The first lock hole 24 is formed in the inner face 1*c* of sprocket 1 and arranged at an intermediate position somewhat displaced toward the phase-advance side with respect to the maximum phase-retard angular position of vane member 9 (in particular, the maximum-circumferential-width vane 16*a* ). Additionally, the first lock hole 24 is formed as a three-stage stepped hole whose bottom face lowers stepwise from the phase-retard side (in other words, the side of phase-advance chamber 12) to the phase-advance side (in other words, the side of phase-retard chamber 11). The first lock hole 24 (i.e., the three-stage stepped groove) is configured to serve as a first lock guide groove.

That is, as seen in FIGS. 5-10, assuming that the inner face 1*c* of sprocket 1 is regarded as an uppermost level, the first lock guide groove (the three-stage stepped groove) is configured to gradually lower from the first bottom face 24*a* via the second bottom face 24*b* to the third bottom face 24*c*, in that order. An inner face 24*d* of the first lock guide groove arranged on the side of phase-retard chamber 11 is formed as an upstanding wall surface (viewing FIGS. 5-10). Hence, in the presence of movement of first lock pin 26 into engagement with the first, second, and third bottom faces 24*a*, 24*b*, and 24*c*, one-by-one, owing to rotary motion of the vane 16*a* in the phase-advance direction, the first lock guide groove permits the tip 26*a* of first lock pin 26 to lower from the inner face 1*c* (the uppermost level) of sprocket 1 through the first and second bottom faces 24*a*-24*b* to the third bottom face 24*c* stepwise in the phase-advance direction. However, the first lock guide groove restricts or inhibits movement of the tip 26*a* in the opposite direction, that is, in the phase-retard direction by means of the stepped groove, namely, the first, second, and third bottom faces 24*a*-24*c*. That is, each of bottom faces 24*a*-24*c* serves as a one-way clutch, in other words, a one-way ratchet drive (simply, a ratchet).

Figure 10:
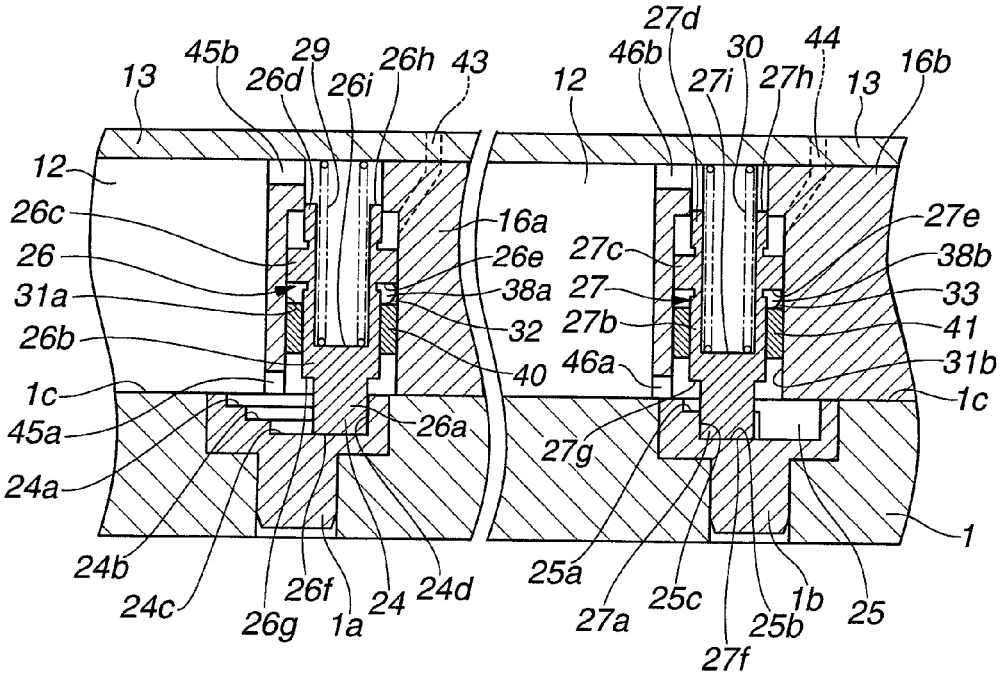
FIG. 10 is a cross-sectional view illustrating two cross sections taken along the line B-B and the line C-C in FIG. 2, and explaining another operation of each of lock pins.

As best seen in FIG. 10, the first lock pin 26 is configured such that movement of first lock pin 26 in the phase-advance direction (in other words, toward the side of phase-retard chamber 11) is restricted by abutment of the outer periphery (the edge) of the tip 26*a* with the upstanding inner face 24*d* of the first lock guide groove.

As seen in FIGS. 2-5, in a similar manner to the first lock hole 24, the second lock hole 25 is formed into an elliptic or oval shape extending in the circumferential direction of sprocket 1. The second lock hole 25 is formed in the inner face 1*c* of sprocket 1 and arranged at an intermediate position somewhat displaced toward the phase-advance side with respect to the maximum phase-retard angular position of vane member 9 (in particular, the middle-circumferential-width vane 16*b*). Additionally, the second lock hole 25 is formed as a two-stage stepped hole whose bottom face lowers stepwise from the phase-retard side (in other words, the side of phase-advance chamber 12) to the phase-advance side (in other words, the side of phase-retard chamber 11). The second lock hole 25 (i.e., the two-stage stepped groove) is configured to serve as a second lock guide groove. That is, as seen in FIGS. 5-10, assuming that the inner face 1*c* of sprocket 1 is regarded as the uppermost level, the second lock guide groove (the two-stage stepped groove) is configured to gradually lower from the first bottom face 25*a* to the second bottom face 25*b*, in that order. An inner face 25*c* of the second lock guide groove arranged on the side of phase-advance chamber 12 is formed as an upstanding wall surface (an upstanding stepped inner face) (viewing FIGS. 5-10). Additionally, the depth of the first bottom face 25*a* of second lock hole 25 is dimensioned to be slightly deeper than that of the first bottom face 24*a* of first lock hole 24. The depth of the second bottom face 25*b* of second lock hole 25 is dimensioned to be identical to the summed depth of the second and third bottom faces 24*b*-24*c* of first lock hole 24 by virtue of the stepped inner face 25*c*. The entire depth of second lock hole 25, that is, the depth of the second bottom face 25*b* of second lock hole 25 is dimensioned or set to be almost the same depth as the third bottom face 24*c* of first lock hole 24. Hence, in the presence of movement of second lock pin 27 into engagement with the first and second bottom faces 25*a* and 25*b*, one-by-one, owing to rotary motion of the vane 16*b* in the phase-advance direction, the second lock guide groove permits the tip 27*a* of second lock pin 27 to lower from the inner face 1*c* (the uppermost level) of sprocket 1 through the first bottom face 25*a* to the second bottom face 25*b* stepwise in the phase-advance direction. However, the second lock guide groove restricts or inhibits movement of the tip 27*a* in the opposite direction, that is, in the phase-retard direction by means of the stepped groove, namely, the first and second bottom faces 25*a*-25*b*. That is, each of bottom faces 25*a*-25*b* serves as a one-way clutch, in other words, a one-way ratchet drive (simply, a ratchet).

As best seen in FIG. 10, the second lock pin 27 is configured such that movement of second lock pin 27 in the phase-retard direction (in other words, toward the side of phase-advance chamber 12) is restricted by abutment of the outer periphery (the edge) of the tip 27*a* with the stepped inner face 25*c* of the second bottom face 25*b* of the second lock guide groove.

Regarding the relative-position relationship of first and second lock holes 24-25 formed in respective lock-hole structural members 1*a*-1*b* of sprocket 1, in a phase wherein the first lock pin 26 is brought into engagement with the first, second, and third bottom faces 24*a*, 24*b*, and 24*c* of first lock hole 24, one-by-one, owing to rotary motion of the vane 16*a* in the phase-advance direction, as seen in FIGS. 5-8, the axial end face of the tip 27*a* of second lock pin 27 is still kept in abutted-engagement with the inner face 1*c* of sprocket 1.

Figure 9:
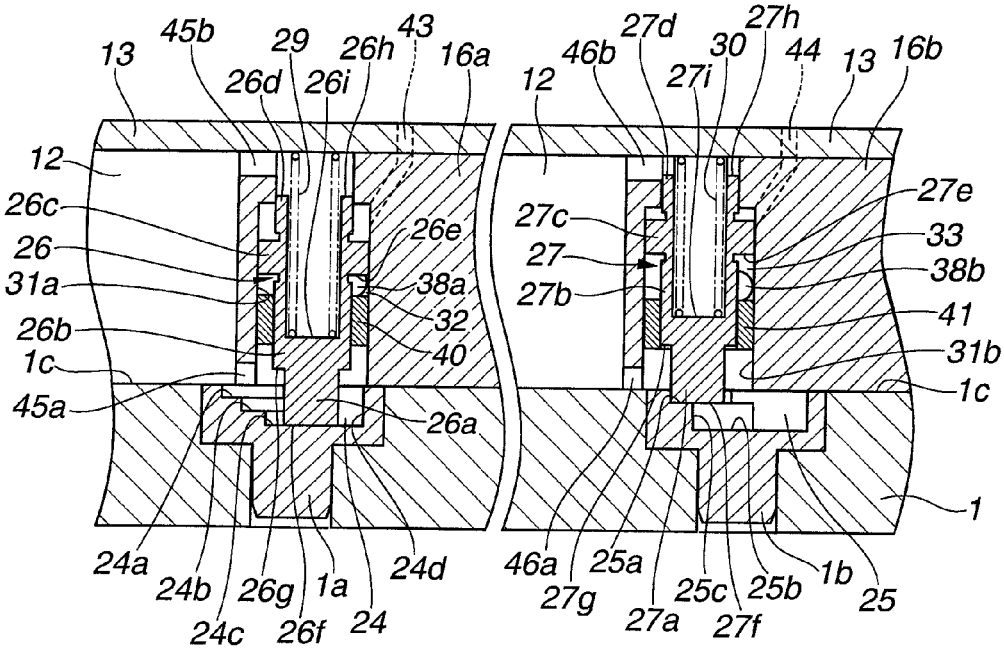
FIG. 9 is a cross-sectional view illustrating two cross sections taken along the line B-B and the line C-C in FIG. 2, and explaining another operation of each of lock pins.

Thereafter, as seen in FIG. 9, when the tip 26*a* of first lock pin 26 slightly moves in the phase-advance direction along the third bottom face 24*c*, the tip 27*a* of second lock pin 27 is brought into abutted-engagement with the first bottom face 25*a*. When the first lock pin 26, still kept in abutted-engagement with the third bottom face 24*c*, further moves in the phase-advance direction, the tip 26*a* of first lock pin 26 is brought into abutted-engagement with the upstanding inner face 24*d* (see FIG. 10). At this point of time, the tip 27*a* of second lock pin 27 is brought into abutted-engagement with the second bottom face 25*b*, and simultaneously the outer periphery (the edge) of the tip 27*a* is brought into abutted-engagement with the stepped inner face 25*c*. In this manner, the relative-position relationship of first and second lock holes 24-25 is preset.

Briefly speaking, as can be seen from the cross sections of FIGS. 5-10, according to rotary motion of vane member 9 relative to sprocket 1 from the phase-retard position (see FIG. 3) toward the phase-advance position (see FIG. 4), the first lock pin 26 is brought into abutted-engagement with the first, second, and third bottom faces 24*a*, 24*b*, and 24*c*, one-by-one (in a stepwise manner), and then the second lock pin 27 is brought into abutted-engagement with the first and second bottom faces 25*a*-25*b*, one-by-one (in a stepwise manner). As discussed above, the first and second lock guide groove structures permit normal rotation of vane member 9 relative to sprocket 1 in the phase-advance direction, but restrict or prevent reverse-rotation (counter-rotation) of vane member 9 relative to sprocket 1 in the phase-retard direction by virtue of a five-stage ratchet action in total. Finally, the angular position of vane member 9 relative to sprocket 1 is held or locked at the intermediate-phase angular position (see FIG. 2) between the maximum phase-retard angular position (see FIG. 3) and the maximum phase-advance angular position (see FIG. 4).

Figure 5:
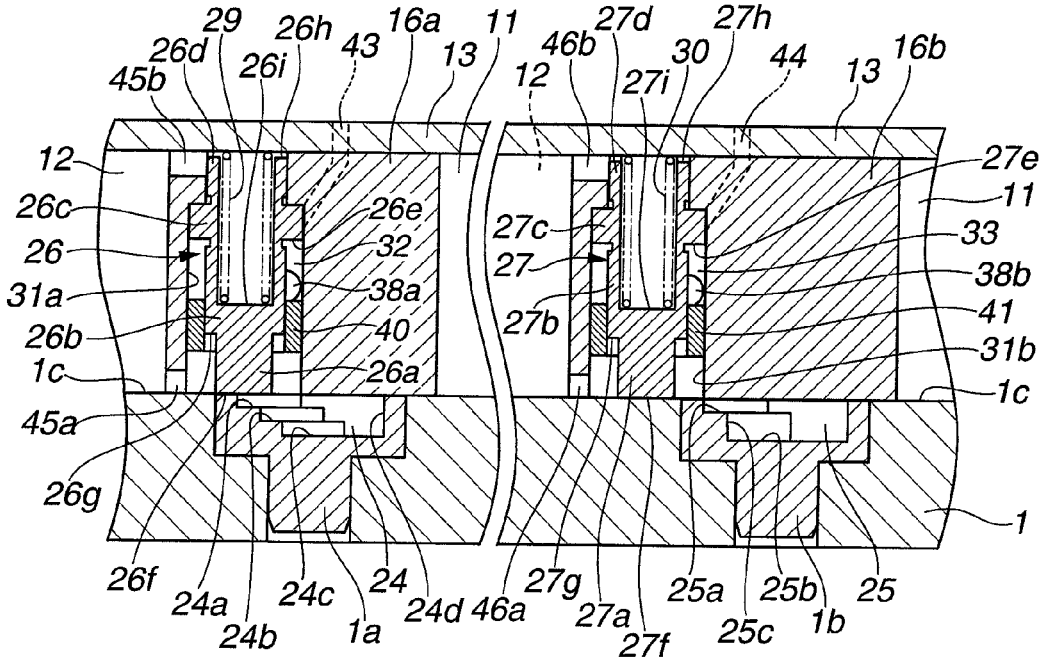
FIG. 5 is a cross-sectional view illustrating two cross sections taken along the line B-B and the line C-C in FIG. 2, and explaining an operation of each of lock pins of the VTC apparatus.

As best seen in FIGS. 1 and 5, the first lock pin 26 is slidably disposed in a first lock-pin hole 31*a* (an axial through hole) formed in the maximum-circumferential-width vane 16*a*. The first lock pin 26 is contoured as a stepped shape, comprised of the comparatively short axial-length minimum-diameter tip 26*a*, a comparatively long axial-length middle-diameter portion 26*b* integrally formed continuously with the minimum-diameter tip 26*a*, and a large-diameter flanged first pressure-receiving portion 26*c* integrally formed on the outer periphery of the rear end 26*d* of the middle-diameter portion 26*b*.

The front end of middle-diameter portion 26*b* is slidably fitted in a very close-fitting bore of a sleeve 40, which sleeve is press-fitted to the front end of the first lock-pin hole 31*a*, in a fluid-tight fashion. The rear end 26*d* is slidably fitted in the first lock-pin hole 31*a* in a fluid-tight fashion. The end face 26*f* of tip 26*a* is formed as a flat face, which can be brought into abutted-engagement (exactly, into wall-contact) with each of bottom faces 24*a*, 24*b*, and 24*c*.

The first lock pin 26 is permanently biased in a direction of movement of first lock pin 26 into engagement with the first lock hole 24 by a spring force of a first spring 29 (biasing means). The first spring 29 is disposed between the bottom face 26*i* of an axial spring bore formed in the middle-diameter portion 26*b* in a manner so as to axially extend from the rear end face and the inner wall surface of front cover 13 under preload.

The first lock pin 26 is also configured such that the same hydraulic pressure in phase-advance chamber 12 acts on the tip 26*a* via an oil hole 45*a* formed in the maximum-circumferential-width vane 16*a* and also acts on the rear end 26*d* via an oil hole 45*b* formed in the maximum-circumferential-width vane 16*a*.

That is, the summed value of the pressure-receiving surface area of the end face 26*f* of tip 26*a*, facing the oil hole 45*a*, and the pressure-receiving surface area of the annular end face 26*g* of the middle-diameter portion 26*b* is set to be identical to the summed value of the pressure-receiving surface area of the rear end face 26*h* of the rear end 26*d*, facing the oil hole 45*b*, and the pressure-receiving surface area of the bottom face 26*i* of the axial spring bore of first spring 29. The oil passages (oil holes 45*a*-45*b*) of the maximum-circumferential-width vane 16*a* are configured such that the same hydraulic pressure in phase-advance chamber 12 simultaneously acts on both ends of first lock pin 26.

Furthermore, the annular lower end face (viewing FIGS. 5-10) of the first pressure-receiving portion 26*c* is configured as a first pressure-receiving surface 26*e*, facing a first unlocking pressure-receiving chamber 32, whereas the annular upper end face (viewing FIGS. 5-10) of the first pressure-receiving portion 26*c* is configured to be opened to the atmosphere via a breather 43 intercommunicating the interior space (i.e., the first lock-pin hole 31*a*) of vane 16*a* and the exterior space of front cover 13.

The second lock pin 27 is slidably disposed in a second lock-pin hole 31*b* (an axial through hole) formed in the middle-circumferential-width vane 16*b*. In a similar manner to the first lock pin 26, the second lock pin 27 is also contoured as a stepped shape, comprised of the comparatively short axial-length minimum-diameter tip 27*a*, a comparatively long axial-length middle-diameter portion 27*b* integrally formed continuously with the minimum-diameter tip 27*a*, and a large-diameter flanged second pressure-receiving portion 27*c* integrally formed on the outer periphery of the rear end 27*d* of the middle-diameter portion 27*b*. The front end of middle-diameter portion 27*b* is slidably fitted in a very close-fitting bore of a sleeve 41, which sleeve is press-fitted to the front end of the second lock-pin hole 31*b*, in a fluid-tight fashion. The rear end 27*d* is slidably fitted in the second lock-pin hole 31*b* in a fluid-tight fashion. The end face 27*f* of tip 27*a* is formed as a flat face, which can be brought into abutted-engagement (exactly, into wall-contact) with each of bottom faces 25*a* and 25*b*.

The second lock pin 27 is permanently biased in a direction of movement of second lock pin 27 into engagement with the second lock hole 25 by a spring force of a second spring 30 (biasing means). The second spring 30 is disposed between the bottom face 27*i* of an axial spring bore formed in the middle-diameter portion 27*b* in a manner so as to axially extend from the rear end face and the inner wall surface of front cover 13 under preload.

The second lock pin 27 is also configured such that the same hydraulic pressure in phase-advance chamber 12 acts on the tip 27*a* via an oil hole 46*a* formed in the middle-circumferential-width vane 16*b* and also acts on the rear end 27*d* via an oil hole 46*b* formed in the middle-circumferential-width vane 16*b*.

That is, the summed value of the pressure-receiving surface area of the end face 27*f* of tip 27*a*, facing the oil hole 46*a*, and the pressure-receiving surface area of the annular end face 27*g* of the middle-diameter portion 27*b* is set to be identical to the summed value of the pressure-receiving surface area of the rear end face 27*h* of the rear end 27*d*, facing the oil hole 46*b*, and the pressure-receiving surface area of the bottom face 27*i* of the axial spring bore of second spring 30. The oil passages (oil holes 46*a*-46*b*) of the middle-circumferential-width vane 16*b* are configured such that the same hydraulic pressure in phase-advance chamber 12 simultaneously acts on both ends of second lock pin 27.

Furthermore, the annular lower end face (viewing FIGS. 5-10) of the second pressure-receiving portion 27*c* is configured as a second pressure-receiving surface 27*e*, facing a second unlocking pressure-receiving chamber 33, whereas the annular upper end face (viewing FIGS. 5-10) of the second pressure-receiving portion 27*c* is configured to be opened to the atmosphere via a breather 44 intercommunicating the interior space (i.e., the second lock-pin hole 31*b*) of vane 16*b* and the exterior space of front cover 13.

As seen in FIGS. 1-5, the previously-discussed phase-change mechanism 3 also includes the first unlocking pressure-receiving chamber 32 defined between the large-diameter stepped portion of first lock-pin hole 31*a* and the first pressure-receiving portion 26*c* of first lock pin 26 and the second unlocking pressure-receiving chamber 33 defined between the large-diameter stepped portion of second lock-pin hole 31*b* and the second pressure-receiving portion 26*c* of second lock pin 27.

The first unlocking pressure-receiving chamber 32 is provided for applying the supplied hydraulic pressure to the first pressure-receiving surface 26*e* so as to cause movement of first lock pin 26 out of engagement with the first lock hole 24 against the spring force of first spring 29. In a similar manner, the second unlocking pressure-receiving chamber 33 is provided for applying the supplied hydraulic pressure to the second pressure-receiving surface 27*e* so as to cause movement of second lock pin 27 out of engagement with the second lock hole 25 against the spring force of second spring 30.

Returning to FIG. 1, hydraulic circuit 5 includes a phase-retard passage 18, a phase-advance passage 19, lock passage 28, an oil pump 20 (serving as a fluid-pressure supply source), and a single electromagnetic directional control valve 21. Phase-retard passage 18 is provided for fluid-pressure supply-and-exhaust for each of phase-retard chambers 11 via the first communication hole 11*a*. Phase-advance passage 19 is provided for fluid-pressure supply-and-exhaust for each of phase-advance chambers 12 via the second communication hole 12*a*. Lock passage 28 is provided for fluid-pressure supply-and-exhaust for each of first and second unlocking pressure-receiving chambers 32-33. Oil pump 20 is provided for supplying working fluid pressure to at least one of phase-retard passage 18 and phase-advance passage 19, and also provided for supplying working fluid pressure to lock passage 28. Single electromagnetic directional control valve 21 is provided for switching between phase-retard passage 18 and phase-advance passage 19, and also provided for switching between working-fluid supply to lock passage 28 and working-fluid exhaust from lock passage 28.

One end of phase-retard passage 18 and one end of phase-advance passage 19 are connected to respective ports (described later) of electromagnetic directional control valve 21. The other end of phase-retard passage 18 is configured to communicate with each of phase-retard chambers 11 via an axial passage portion 18*a* formed in a substantially cylindrical passage structural member 37 and the radially-extending first communication hole 11*a* formed in the vane rotor 15. Passage structural member 37 is installed and held in the vane rotor 15 of vane member 9 and the central cylindrical-hollow seal member insertion guide portion 15*a*. The other end of phase-advance passage 19 is configured to communicate with each of phase-advance chambers 12 via an axially-extending but partly-radially-bent passage portion 19*a* formed in the passage structural member 37 and the radially-extending second communication hole 12*a* formed in the vane rotor 15.

One end of lock passage 28 is connected to a lock port 58 (described later) of electromagnetic directional control valve 21. The other end of lock passage 28, serving as a fluid-passage portion 28*a*, is formed to extend axially in the passage structural member 37, and then bent radially. The radially-bent portion of fluid-passage portion 28*a* is configured to communicate with respective unlocking pressure-receiving chambers 32-33 via first and second oil holes 38*a*-38*b* formed in the vane rotor 15 and branching away.

Although it is not clearly shown, the outside end of passage structural member 37 is fixedly connected to a chain cover (not shown), and thus passage structural member 37 is constructed as a stationary member (a non-rotary member). As previously discussed, passage structural member 37 has fluid-passage portions 18*a*, 19*a*, and 28*a* formed therein.

Three axially-spaced annular seals 39, 39, 39 are disposed between the outer periphery of the inside end of passage structural member 37 and the inner periphery of cylindrical fitting bore 15*d* of vane rotor 15. In more detail, annular seals 39 are fitted into and retained in respective seal grooves formed in the outer periphery of passage structural member 37, so as to seal or partition among the ends of fluid-passage portions 18*a*, 19*a*, and 28*a* in a fluid-tight fashion.

In the shown embodiment, an internal gear rotary pump, such as a trochoid pump having inner and outer rotors, is used as the oil pump 20 driven by the engine crankshaft. During operation of oil pump 20, when the inner rotor is driven, the outer rotor also rotates in the same rotational direction as the inner rotor by mesh between the outer-rotor inner-toothed portion and the inner-rotor outer-toothed portion. Working fluid in an oil pan 23 is introduced through a suction passage 20*b* into the pump, and then discharged through a discharge passage 20*a*. Part of working fluid discharged from oil pump 20 is delivered through a main oil gallery M/G to sliding or moving engine parts. The remaining working fluid discharged from oil pump 20 is delivered to electromagnetic directional control valve 21. An oil filter 50*a* is disposed in the downstream side of discharge passage 20*a*. Also, a flow control valve 50*b* is provided to appropriately control an amount of working fluid discharged from oil pump 20 into discharge passage 20*a*, thus enabling surplus working fluid discharged from oil pump 20 to be directed to the oil pan 23.

Figure 11:
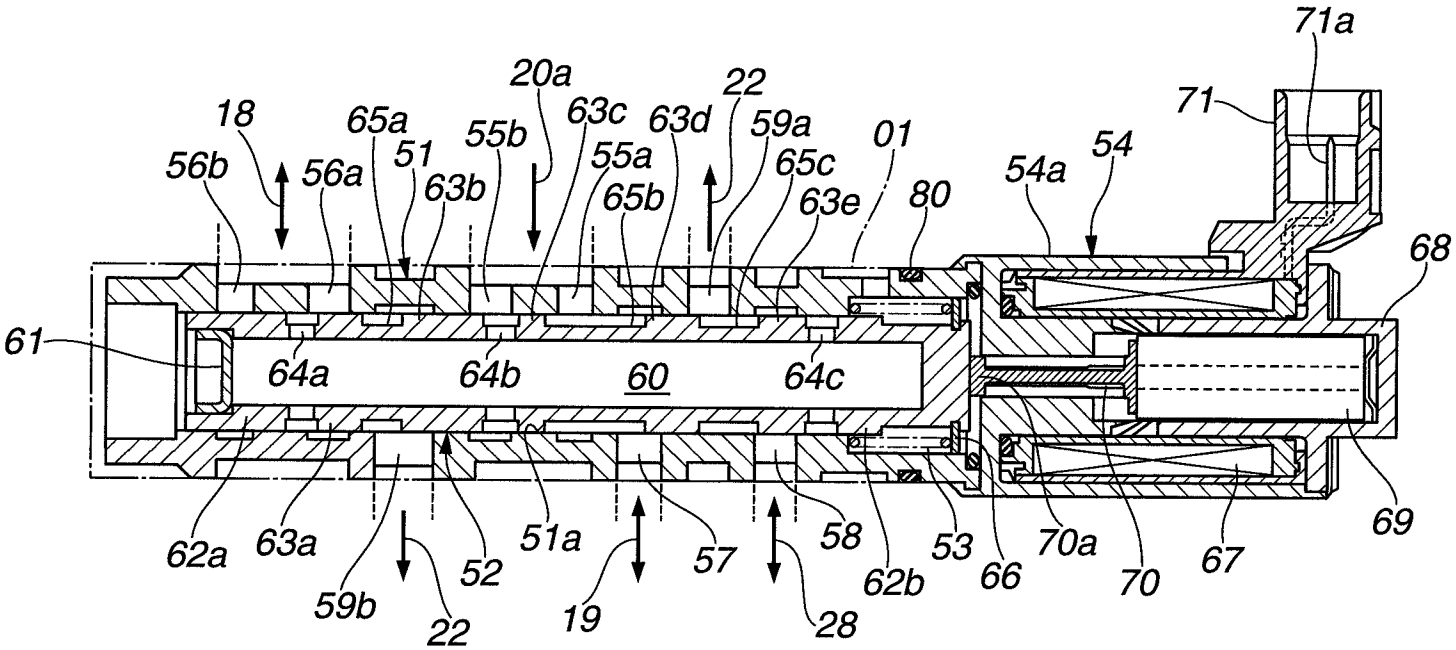
FIG. 11 is a longitudinal cross-sectional view of the electromagnetic directional control valve of the embodiment.

As seen in FIGS. 1 and 11, electromagnetic directional control valve 21 is an electromagnetic-solenoid operated, six-port, six-position, spring-offset, proportional control valve. Electromagnetic directional control valve 21 is comprised of a substantially cylindrical-hollow, axially-elongated valve body (a valve housing) 51, a valve spool (an electrically-actuated valve element) 52 slidably installed in the valve body 51 in a manner so as to axially slide in a very close-fitting bore of valve body 51, a valve spring 53 installed inside of one axial end (the right-hand end, viewing FIG. 11) of valve body 51 for permanently biasing the valve spool 52 in the axially-rightward direction (viewing FIG. 11), and an electromagnetic solenoid 54 attached to the rightmost end of valve body 51 so as to cause axial sliding movement of valve spool 52 against the spring force of valve spring 53.

Valve body 51 is inserted and installed in a valve accommodation bore 01 formed in an engine cylinder block. Valve body 51 has a plurality of ports (through holes) formed in a manner so as to penetrate inner and outer peripheral walls of valve body 51. More concretely, valve body 51 has two adjacent working-fluid introduction ports (i.e., first and second introduction ports 55*a*-55*b*), two adjacent working-fluid supply ports (i.e., first and second supply ports 56*a*-56*b*), a third supply port 57, a lock port 58, and a pair of drain ports (i.e., first and second drain ports 59*a*-59*b*). First and second introduction ports 55*a*-55*b* are arranged in a substantially middle position in the axial direction of valve body 51, and configured to communicate with the discharge passage 20*a* of oil pump 20. First and second supply ports 56*a*-56*b* are arranged in the left-hand side axial position (viewing FIG. 11) of valve body 51, and configured to communicate with the phase-retard passage 18. Third supply port 57 is arranged in a substantially middle position in the axial direction of valve body 51, and configured to communicate with the phase-advance passage 19. Lock port 58 is arranged in the root of valve body 51 (i.e., on the side of electromagnetic solenoid 54), and configured to communicate with the lock passage 28. First and second drain ports 59*a*-59*b* are arranged on both sides of first and second introduction ports 55*a*-55*b*, and configured to communicate with a drain passage 22 connected to the oil pan 23. Also provided is an oil seal 80 fitted onto the outer periphery of the root of valve body 51 (on the side of electromagnetic solenoid 54) to provide a fluid-tight seal between the outer periphery of the root of valve body 51 and the inner periphery of valve accommodation bore 01.

Valve spool 52 is a substantially cylindrical-hollow member closed at one axial end (the right-hand end, viewing FIG. 11) by its bottom wall. The interior space of valve spool 52 is formed as a central axially-extending passage hole 60 through which a working fluid flow is permitted. The left-hand end of passage hole 60 is hermetically closed by means of a plug 61. Valve spool 52 has a pair of axially-spaced cylindrical guide portions (i.e., first and second guide portions 62*a*-62*b*) formed at both ends of the outer periphery of valve spool 52 to ensure a smooth sliding movement of valve spool 52 along the very close-fitting bore (the inner peripheral surface 51*a*) of valve body 51. Valve spool 52 has axially-spaced five land portions, that is, first, second, third, fourth, and fifth land portions 63*a*, 63*b*, 63*c*, 63*d*, and 63*e*, formed or machined on the outer peripheral surface of valve spool 52 and arranged between first and second guide portions 62*a*-62*b*. The first guide portion 62*a* also serves as a leftmost land portion (i.e., a sixth land portion) associated with the second supply port 56*b* and configured to define, in cooperation with the adjacent land portion 63*a*, an annular groove formed in the outer peripheral surface of valve spool 52 in a manner so as to communicate with a first communication hole 64*a* (described later). The second guide portion 62*b* also serves as a rightmost land portion (i.e., a seventh land portion) configured to define, in cooperation with the adjacent land portion 63*e*, an annular groove formed in the outer peripheral surface of valve spool 52 in a manner so as to communicate with a third communication hole 64*c* (described later).

Valve spool 52 has three communication holes, namely, the first communication hole 64*a*, a second communication hole 64*b*, and the third communication hole 64*c*. First communication hole 64*a* is a radially-penetrating through hole arranged between the first land portion 63*a* and the first guide portion 62*a*, and configured to permit the first supply port 56*a* to appropriately communicate with the passage hole 60 depending on a given axial position of valve spool 52. Second communication hole 64*b* is a radially-penetrating through hole arranged between the second land portion 63*b* and the third land portion 63*c*, and configured to permit the second introduction port 55*b* to appropriately communicate with the passage hole 60 depending on a given axial position of valve spool 52. Third communication hole 64*c* is a radially-penetrating through hole arranged between the second guide portion 62*b* and the fifth land portion 63*e*, and configured to permit the lock port 58 to appropriately communicate with the passage hole 60 depending on a given axial position of valve spool 52.

Also, valve spool 52 has a first annular passage groove 65*a*, a second annular passage groove 65*b*, and a third annular passage groove 65*c*, all of which are formed in the outer peripheral surface of valve spool 52. First annular passage groove 65*a* is arranged between the first land portion 63*a* and the second land portion 63*b*. Second annular passage groove 65*b* is arranged between the third land portion 63*c* and the fourth land portion 63*d*. Third annular passage groove 65*c* is arranged between the fourth land portion 63*d* and the fifth land portion 63*e*. Also, valve spool 52 has three annular grooves formed in the outer peripheral surface and configured to be conformable to respective axial positions of formation of communication holes 64*a*, 64*b*, and 64*c*.

Valve spring 53 is disposed between the stepped face (the shoulder portion) of the root of valve body 51 and an annular spring retainer 66 fitted onto the outer periphery of the root (the right-hand end, viewing FIG. 11) of valve spool 52 under preload. Hence, the spring force of valve spring 53 permanently biases the valve spool 52 toward the electromagnetic solenoid 54.

Electromagnetic solenoid 54 is mainly constructed by a cylindrical solenoid casing 54*a*, an electromagnetic coil 67, which is accommodated and held in the solenoid casing 54*a* and to which a control current from an electronic control unit (simply, a controller) 34 is outputted, a cylindrical stationary yoke 68 fitted or fixed onto the inner periphery of electromagnetic coil 67 and closed at one end, a movable plunger 69, and a drive rod 70. Movable plunger 69 is installed in the stationary yoke 68 in a manner so as to be axially slidable. Drive rod 70 is formed integral with the tip (the leftmost end face, viewing FIG. 11) of movable plunger 69. The tip 70*a* of drive rod 70 is kept in contact with the basal-end face (the right-hand end face, viewing FIG. 11) of valve spool 52 to enable the basal-end face of valve spool 52 to be pushed in the leftward direction (viewing FIG. 11) against the spring force of valve spring 53. A synthetic-resin connector 71 is installed at the rear end of solenoid casing 54*a*. Connector 71 has an electrical-connection terminal 71*a* through which electromagnetic coil 67 is electrically connected to the controller 34.

As seen in FIGS. 11-17, electromagnetic directional control valve 21 is configured to move the valve spool 52 to either one of six axial positions by the two opposing pressing forces, produced by a spring force of valve spring 53 and a control current generated from controller 34 and flowing through the electromagnetic coil 67 of solenoid 54, so as to change a state of fluid-communication between the discharge passage 20*a* and each of three passages (that is, phase-retard passage 18, phase-advance passage 19, and lock passage 28) and simultaneously change a state of fluid-communication between the drain passage 22 and each of the three passages 18, 19, and 28, depending on a selected one of the six positions of valve spool 52.

[Position Control of Valve Spool]

Figure 17:
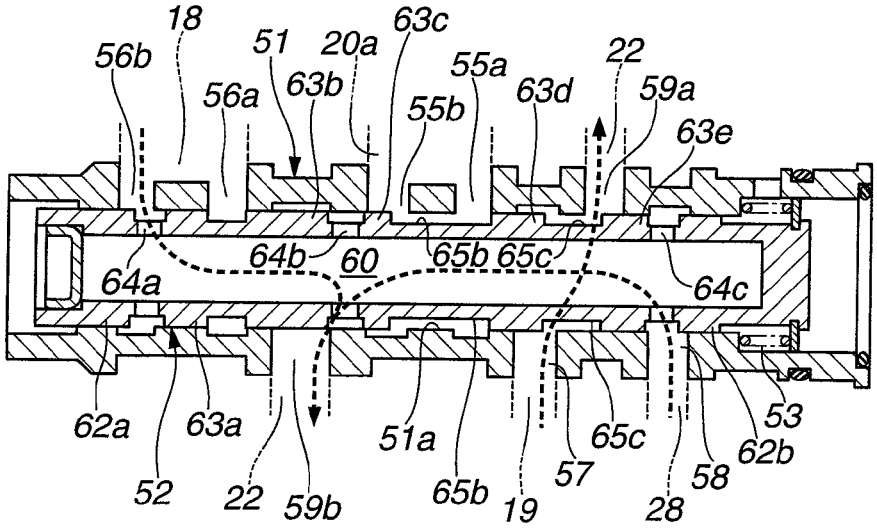
FIG. 17 is a longitudinal cross-sectional view of the valve spool, positioned in a fifth position.
Figure 18:
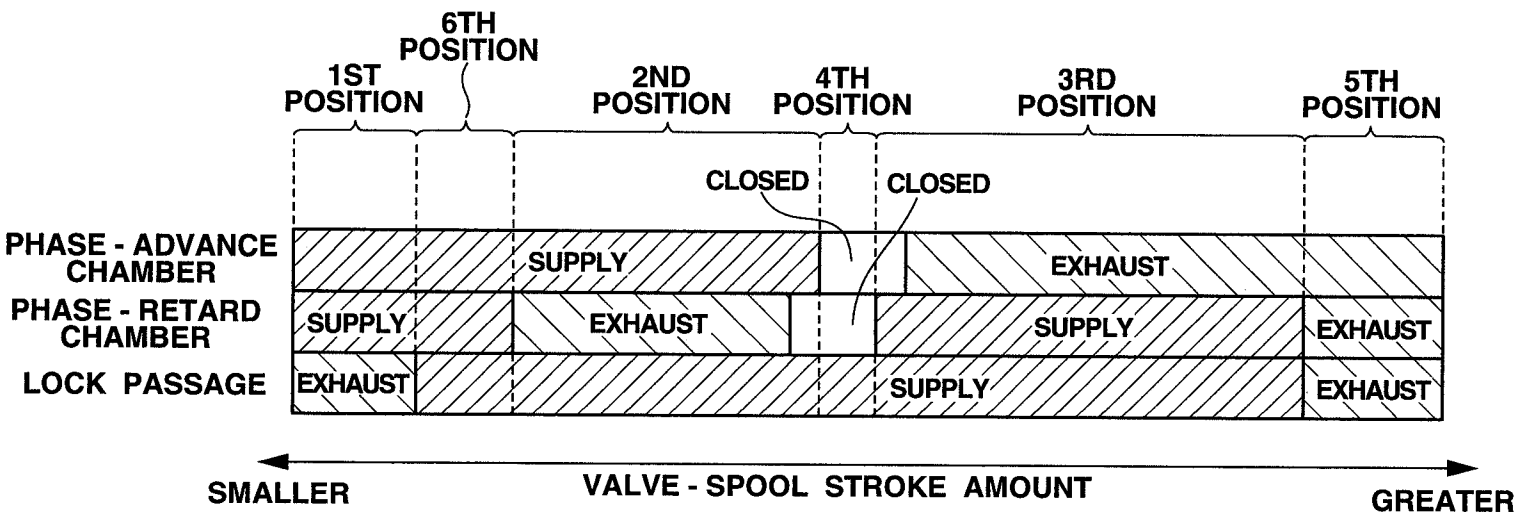
FIG. 18 is a table showing the relationship among a stroke amount of the valve spool (i.e., an axial spool position), working-fluid supply to each of a phase-advance chamber, a phase-retard chamber, and a lock passage, and working-fluid exhaust from each of the phase-advance chamber, the phase-retard chamber, and the lock passage.

Position control of valve spool 52 of electromagnetic directional control valve 21 of the first embodiment is hereunder described in detail by reference to the table of FIG. 18 showing the relationship between the stroke amount (the axial position) of valve spool 52 and the working-fluid supply/exhaust to and from each of phase-retard passage 18 (phase-retard chambers 11), phase-advance passage 19 (phase-advance chambers 12) and lock passage 28 (first and second unlocking pressure-receiving chambers 32-33) and the cross sections of FIGS. 12-17, respectively showing the first position, the sixth position, the second position, the fourth position, the third position, and the fifth position of valve spool 52.

Figure 12:
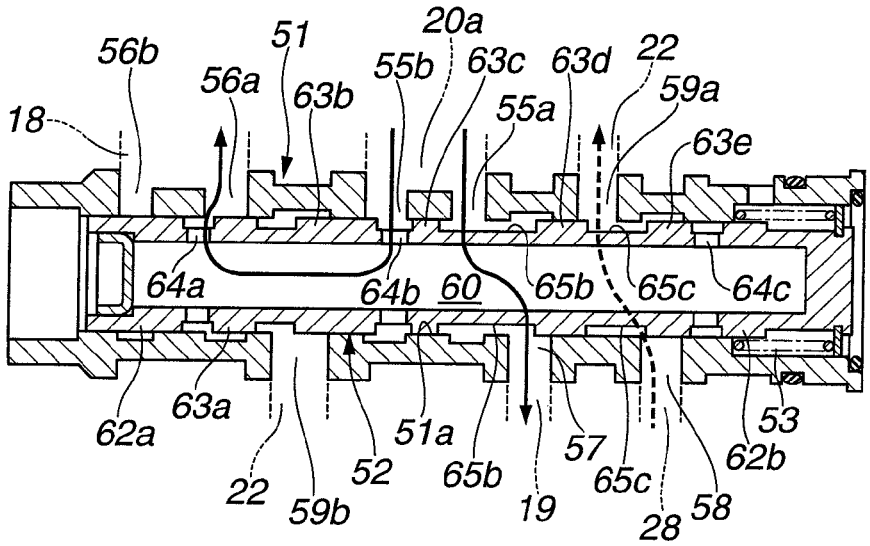
FIG. 12 is a longitudinal cross-sectional view of a valve spool of the electromagnetic directional control valve of the embodiment, positioned in a first position.

First of all, as shown in FIGS. 11-12, when valve spool 52 is positioned at the maximum rightward axial position (i.e., the first position), in other words, the spring-loaded (spring-offset) position by the spring force of valve spring 53, fluid-communication between the second introduction port 55*b* and the first supply port 56*a* through the first and second communication holes 64*a*-64*b* and passage hole 60 is established, and fluid-communication between the first introduction port 55*a* and the third supply port 57 through the second annular passage groove 65*b* formed in the outer peripheral surface of valve spool 52 is established. Simultaneously, fluid-communication between the lock port 58 and the first drain port 59*a* through the third annular passage groove 65*c* is established.

Figure 13:
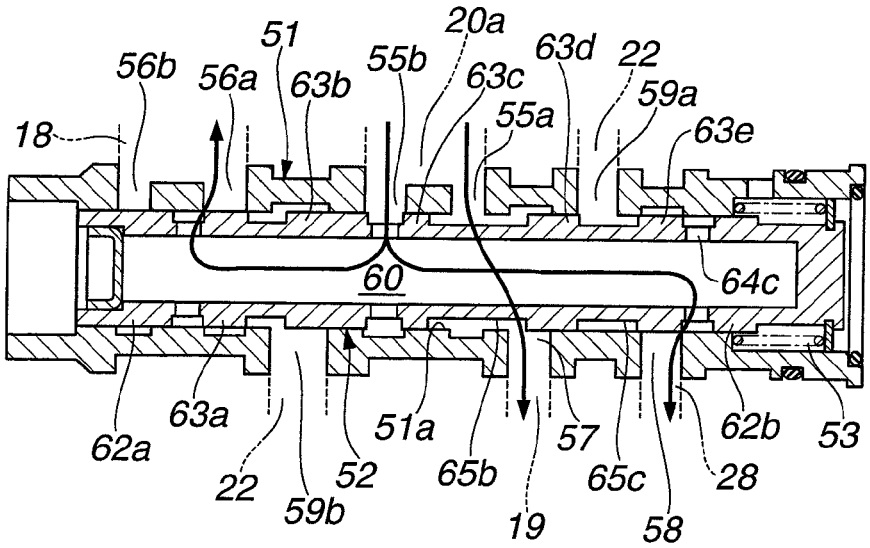
FIG. 13 is a longitudinal cross-sectional view of the valve spool, positioned in a sixth position.

Secondly, as shown in FIG. 13, when valve spool 52 has been slightly displaced leftward from the maximum rightward axial position (i.e., the first position) against the spring force of valve spring 53 by energizing the electromagnetic coil 67 of solenoid 54, and thus positioned at the sixth position, on the one hand, fluid-communication between the second introduction port 55*b* and the first supply port 56*a* and fluid-communication between the first introduction port 55*a* and the third supply port 57 remain unchanged. On the other hand, fluid-communication between the lock port 58 and the first drain port 59*a* becomes blocked, but fluid-communication between the second introduction port 55*b* and the lock port 58 through the third communication hole 64*c* and passage hole 60 becomes established.

Figure 14:
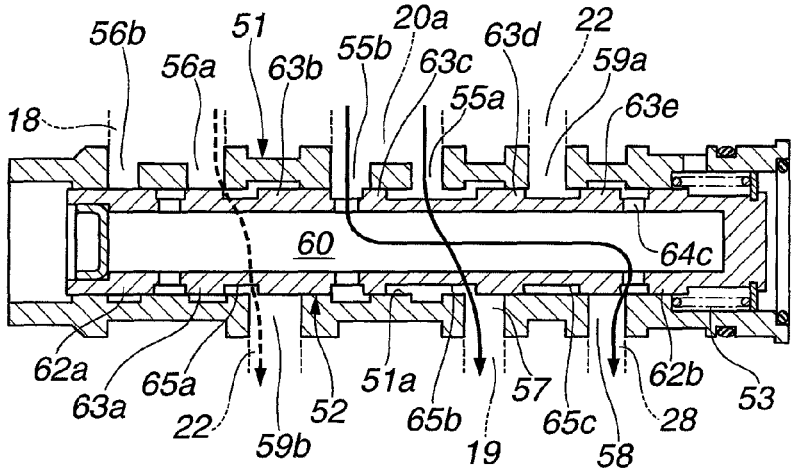
FIG. 14 is a longitudinal cross-sectional view of the valve spool, positioned in a second position.

Thirdly, as shown in FIG. 14, when valve spool 52 has been further displaced leftward from the sixth position by energizing the solenoid 54 with an increase in electric current flowing through the electromagnetic coil 67, and thus positioned at the second position, fluid-communication between the first introduction port 55*a* and the third supply port 57 and fluid-communication between the second introduction port 55*b* and the lock port 58 remain unchanged. Fluid-communication between the first supply port 56*a* and the second drain port 59*b* through the first annular passage groove 65*a* becomes established.

Figure 15:
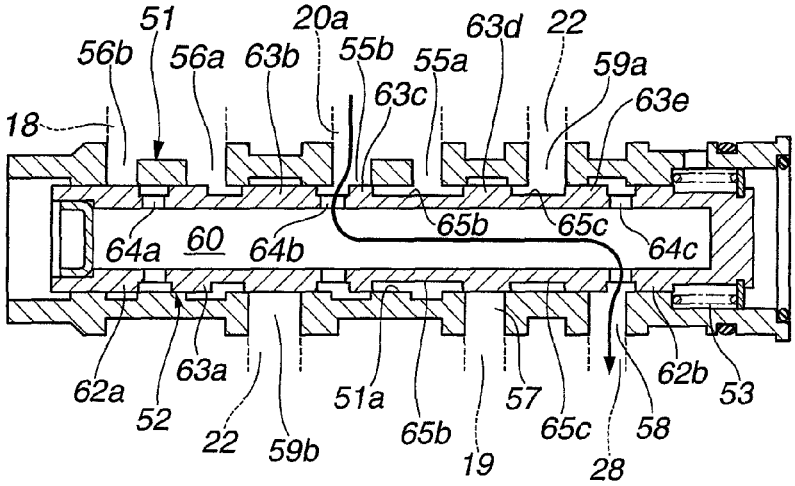
FIG. 15 is a longitudinal cross-sectional view of the valve spool, positioned in a fourth position.

Fourthly, as shown in FIG. 15, when valve spool 52 has been further displaced leftward from the second position by energizing the solenoid 54 with a further increase in electric current flowing through the electromagnetic coil 67, and thus positioned at the fourth position, fluid-communication between the first introduction port 55*a* and the third supply port 57 and fluid-communication between the first supply port 56*a* and the second drain port 59*b* become blocked. Fluid-communication between the second introduction port 55*b* and the lock port 58 remains unchanged.

Figure 16:
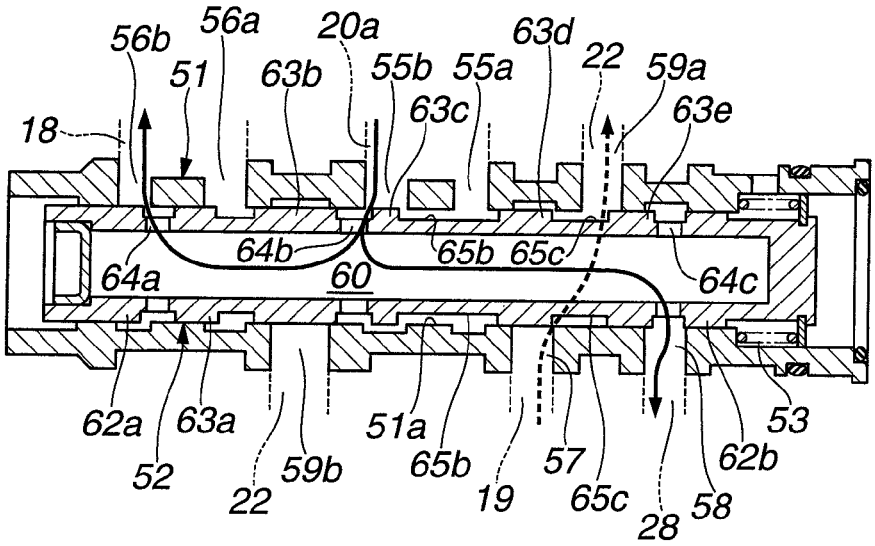
FIG. 16 is a longitudinal cross-sectional view of the valve spool, positioned in a third position.

Fifthly, as shown in FIG. 16, when valve spool 52 has been further displaced leftward from the fourth position by energizing the solenoid 54 with a still further increase in electric current flowing through the electromagnetic coil 67, and thus positioned at the third position, fluid-communication between the second introduction port 55*b* and the lock port 58 remains unchanged. Simultaneously, fluid-communication between the second introduction port 55*b* and the second supply port 56*b* through the first and second communication holes 64*a*-64*b* and passage hole 60 becomes established, and fluid-communication between the third supply port 57 and the first drain port 59*a* through the third annular passage groove 65*c* becomes established.

Sixthly, as shown in FIG. 17, when valve spool 52 has been further displaced leftward from the third position by energizing the solenoid 54 with a maximum amount of electric current flowing through the electromagnetic coil 67 of solenoid 54, and thus positioned at the fifth position, the second supply port 56*b* and the lock port 58 both communicate with the second drain port 59*b* through the passage hole 60. Simultaneously, the third supply port 57 communicates with the first drain port 59*a* through the third annular passage groove 65*c*.

As discussed above, electromagnetic directional control valve 21 of the first embodiment is configured to change the path of flow through the directional control valve 21 by selective switching among the ports depending on a given axial position of valve spool 52, determined based on latest up-to-date information about an engine operating condition (e.g., engine speed and engine load), thereby changing a relative angular phase of vane member 9 (camshaft 2) to sprocket 1 (the crankshaft) and also enabling selective switching between locked and unlocked states of position-hold mechanism 4, in other words, selective switching between a locked (engaged) state of lock pins 26-27 with respective lock holes 24-25 and an unlocked (disengaged) state of lock pins 26-27 from respective lock holes 24-25. Accordingly, by means of electromagnetic directional control valve 21 of the first embodiment as previously discussed, free rotation of vane member 9 relative to sprocket 1 can be enabled (permitted) or disabled (restricted) depending on the engine operating condition.

Controller (ECU) 34 generally comprises a microcomputer. Controller 34 includes an input/output interface (I/O), memories (RAM, ROM), and a microprocessor or a central processing unit (CPU). The input/output interface (I/O) of controller 34 receives input information from various engine/vehicle switches and sensors, namely a crank angle sensor (a crank position sensor), an airflow meter, an engine temperature sensor (e.g., an engine coolant temperature sensor), a throttle opening sensor (a throttle position sensor), a cam angle sensor, an oil-pump discharge pressure sensor, and the like. The crank angle sensor is provided for detecting revolution speeds of the engine crankshaft and for calculating an engine speed Ne. The airflow meter is provided for generating an intake-air flow rate signal indicating an actual intake-air flow rate or an actual air quantity. The engine temperature sensor is provided for detecting an actual operating temperature of the engine. The cam angle sensor is provided for detecting latest up-to-date information about an angular phase of camshaft 2. The discharge pressure sensor is provided for detecting a discharge pressure of working fluid discharged from oil pump 20. Within controller 34, the central processing unit (CPU) allows the access by the I/O interface of input informational data signals from the previously-discussed engine/vehicle switches and sensors, so as to detect the current engine operating condition, and also to generate a control pulse current, determined based on latest up-to-date information about the detected engine operating condition and the detected discharge pressure, to the electromagnetic coil 67 of solenoid 54 of electromagnetic directional control valve 21, for controlling the axial position of the sliding valve spool 52, thus achieving selective switching among the ports depending on the controlled axial position of valve spool 52.

Details of operation of the valve timing control apparatus of the embodiment are hereunder described.

For instance, when an ignition switch has been turned OFF after normal vehicle traveling and thus the engine has stopped rotating, oil pump 20 is placed into an inoperative state. At this time, working-fluid supply to phase-retard chamber 11 or phase-advance chamber 12 becomes stopped, and also working-fluid supply to each of first and second unlocking pressure-receiving chambers 32-33 becomes stopped.

That is, when the ignition switch becomes turned OFF under a state where vane member 9 has been placed into a phase-retard angular position by the working-fluid pressure supply to each of phase-retard chambers 11 during idling before the engine is brought into a stopped state, alternating torque, acting on camshaft 2 immediately before the engine stops, occurs. In particular, when rotary motion of vane member 9 relative to sprocket 1 in the phase-advance direction occurs owing to the negative torque of alternating torque acting on camshaft 2 and thus the angular position of vane member 9 relative to sprocket 1 reaches the intermediate-phase angular position (see FIG. 2), the tip 26*a* of first lock pin 26 and the tip 27*a* of second lock pin 27 are brought into engagement with respective lock holes 24-25 by the spring forces of first and second springs 29-30 (see FIG. 10). As a result of this, the angular position of vane member 9 relative to sprocket 1 is held or locked at the intermediate-phase angular position (see FIG. 2) between the maximum phase-retard angular position (see FIG. 3) and the maximum phase-advance angular position (see FIG. 4).

Figure 6:
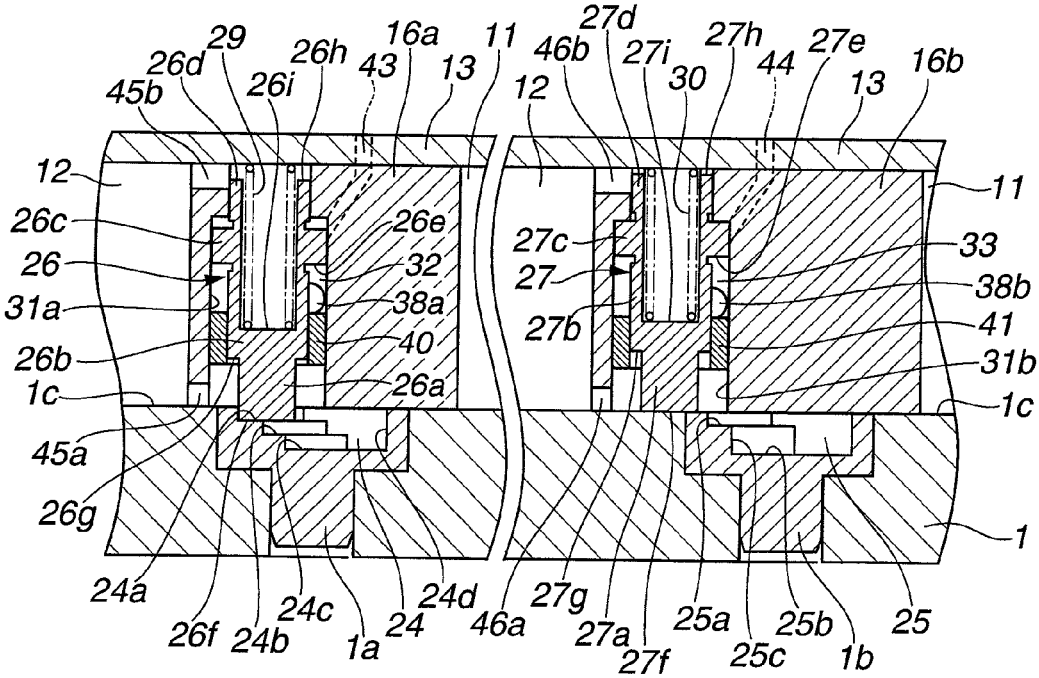
FIG. 6 is a cross-sectional view illustrating two cross sections taken along the line B-B and the line C-C in FIG. 2, and explaining another operation of each of lock pins.

More concretely, when a slight rotary motion of vane member 9 relative to sprocket 1 in the phase-advance direction occurs owing to the negative torque of alternating torque acting on camshaft 2, as shown in FIGS. 5-6, the tip 26*a* of first lock pin 26 is brought into abutted-engagement with the first bottom face 24*a* of first lock hole 24. At this time, even when vane member 9 tends to rotate relative to sprocket 1 in the opposite direction (i.e., in the phase-retard direction) owing to the positive torque of alternating torque acting on camshaft 2, such a rotary motion of vane member 9 in the phase-retard direction can be restricted by abutment of the outer periphery (the edge) of the tip 26*a* of first lock pin 26 with the upstanding stepped inner face of first bottom face 24*a*.

Figure 7:
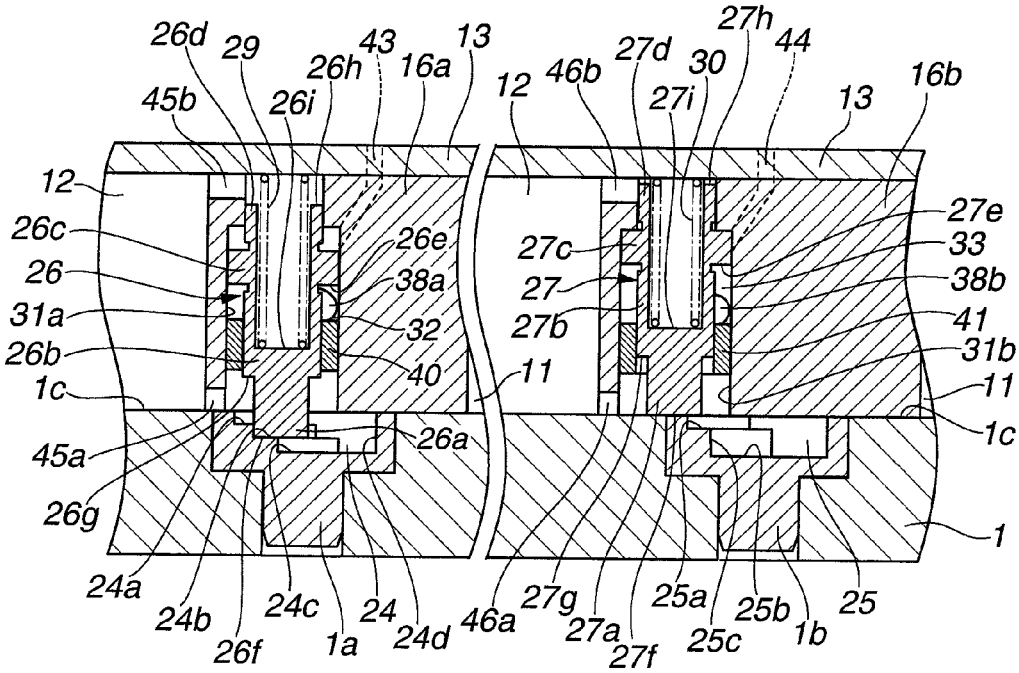
FIG. 7 is a cross-sectional view illustrating two cross sections taken along the line B-B and the line C-C in FIG. 2, and explaining a further operation of each of lock pins.
Figure 8:
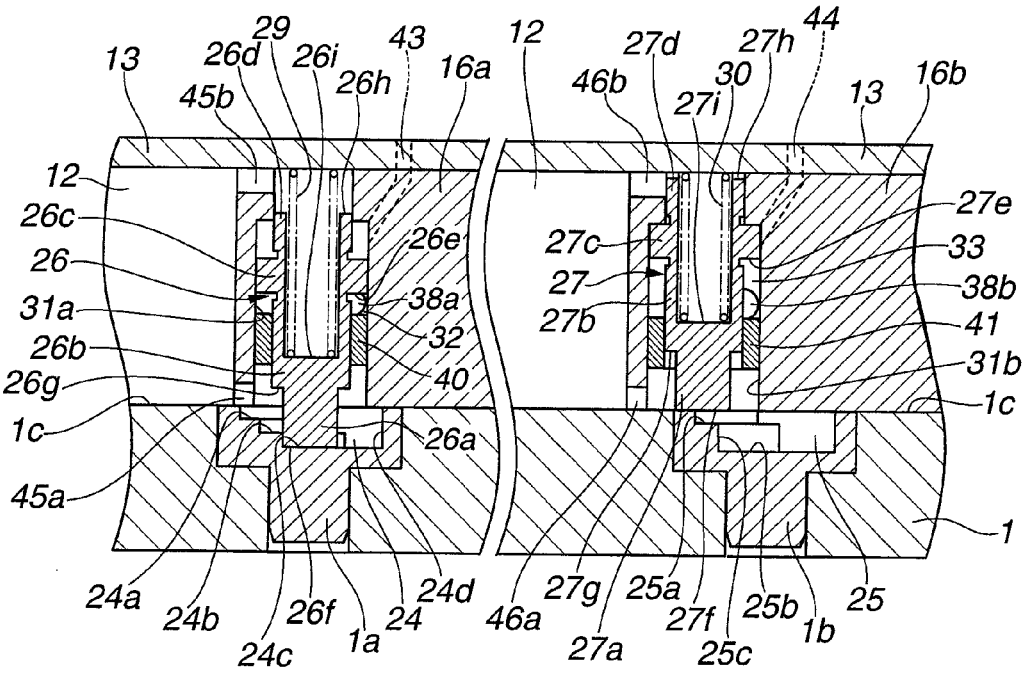
FIG. 8 is a cross-sectional view illustrating two cross sections taken along the line B-B and the line C-C in FIG. 2, and explaining a still further operation of each of lock pins.

Thereafter, when a further rotary motion of vane member 9 relative to sprocket 1 in the phase-advance direction occurs owing to the negative torque acting on camshaft 2, as shown in FIGS. 7-9, first lock pin 26 lowers from the second bottom face 24*b* to the third bottom face 24*c* stepwise in the phase-advance direction and thus the tip 26*a* of first lock pin 26 is brought into abutted-engagement with the third bottom face 24*c*. Then, by virtue of the ratchet action, the tip 26*a* of first lock pin 26 tends to move along the third bottom face 24*c* in the phase-advance direction. In a similar manner, as shown in FIGS. 9-10, by virtue of the ratchet action, second lock pin 27 lowers from the first bottom face 25*a* to the second bottom face 25*b* stepwise in the phase-advance direction and thus the tip 27*a* of second lock pin 27 is brought into abutted-engagement with the second bottom face 25*b*. Finally, second lock pin 27 is held at its locked position, at which the tip 27*a* of second lock pin 27 has been engaged with the second bottom face 25*b*.

At this time, as shown in FIG. 10, on the one hand, first lock pin 26 is stably held at its locked position, at which the tip 26*a* of first lock pin 26 has been engaged with the third bottom face 24*c*, by abutment of the outer periphery (the edge) of the tip 26*a* with the upstanding inner face 24*d* arranged on the side of phase-retard chamber 11 and vertically extending from the third bottom face 24*c* (viewing FIGS. 5-10). On the other hand, second lock pin 27 is stably held at its locked position, at which the tip 27*a* of second lock pin 27 has been engaged with the second bottom face 25*b*, by abutment of the outer periphery (the edge) of the tip 27*a* with the upstanding stepped inner face 25*c* arranged on the side of phase-advance chamber 12 and vertically extending from the second bottom face 25*b* (viewing FIGS. 5-10).

Regarding electromagnetic directional control valve 21 with the ignition switch turned OFF, there is no supply of electric pulse current from controller 34 to the electromagnetic coil 67 of solenoid 54. Thus, valve spool 52 is positioned and kept at the maximum rightward axial position (i.e., the first position) shown in FIGS. 11-12 by the spring force of valve spring 53. Hence, both of the phase-retard passage 18 and the phase-advance passage 19 communicate with the discharge passage 20*a*, whereas the lock passage 28 communicates with the drain passage 22.

Thereafter, immediately after the ignition switch has been turned ON to start up the engine, due to initial explosion (the start of cranking) oil pump 20 begins to operate. Thus, as seen in FIG. 12, the discharge pressure of working fluid discharged from oil pump 20 is delivered to each phase-retard chamber 11 and each phase-advance chamber 12 via respective passages 18 and 19. On the other hand, the lock passage 28 is kept in a fluid-communication relationship with the drain passage 22. Thus, first and second lock pins 26-27 are kept in engagement with respective lock holes 24-25 by the spring forces of first and second springs 29-30.

As previously discussed, the axial position of valve spool 52 of electromagnetic directional control valve 21 is controlled by means of controller 34 depending on latest up-to-date information about the detected engine operating condition and the detected pump discharge pressure. Hence, with the engine at an idle rpm, at which the discharge pressure of working fluid discharged from oil pump 20 is unstable, the engaged states (locked states) of first and second lock pins 26-27 are maintained.

After this, immediately before the engine operating condition shifts from the idling condition to a low-speed low-load operating range or a high-speed high-load operating range, a control current is outputted from controller 34 to the electromagnetic coil 67. Thus, valve spool 52 is slightly displaced leftward against the spring force of valve spring 53 (see the sixth position shown in FIG. 13). As a result, fluid communication between the discharge passage 20*a* and the lock passage 28 through the passage hole 60 becomes established. On the other hand, both of the phase-retard passage 18 and the phase-advance passage 19 remain kept in a fluid-communication relationship with the discharge passage 20*a*.

Therefore, working fluid can be supplied via the lock passage 28 to each of first and second unlocking pressure-receiving chambers 32-33. Hence, movement of the tip 26*a* of first lock pin 26 out of engagement with the first lock hole 24 against the spring force of first spring 29 occurs and simultaneously movement of the tip 27*a* of second lock pin 27 out of engagement with the second lock hole 25 against the spring force of second spring 30 occurs. Thus, free rotation of vane member 9 relative to sprocket 1 in the normal-rotational direction or in the reverse-rotational direction can be permitted.

Hereupon, assume that working-fluid pressure is merely delivered to either one of phase-retard chamber 11 and phase-advance chamber 12. In such a case, a rotary motion of vane member 9 relative to sprocket 1 in either one of the phase-retard direction and the phase-advance-direction occurs, and hence the first lock pin 26 has to receive a shearing force caused by a circumferential displacement of the first lock-pin hole 31*a* of the maximum-circumferential-width vane 16*a* of vane member 9 relative to the first lock hole 24 of first lock-hole structural member 1*a* of sprocket 1. In a similar manner, the second lock pin 27 has to receive a shearing force caused by a circumferential displacement of the second lock-pin hole 31*b* of the middle-circumferential-width vane 16*b* of vane member 9 relative to the second lock hole 25 of second lock-hole structural member lb of sprocket 1. As a result of this, the first lock pin 26 is brought into a so-called jammed (bitten) condition between the first lock-pin hole 31*a* and the first lock hole 24 displaced relatively, while the second lock pin 27 is brought into a so-called jammed (bitten) condition between the second lock-pin hole 31*b* and the second lock hole 25 displaced relatively. Hence, there is a possibility that the locked (engaged) state of lock pins 26-27 with respective lock holes 24-25 cannot be easily released.

Also, assume that there is no hydraulic-pressure supply to both of the phase-retard chamber 11 and the phase-advance chamber 12. In such a case, owing to alternating torque transmitted from the camshaft 2, vane member 9 tends to flutter, and thus vane member 9 (especially, the maximum-circumferential-width vane 16*a*) is brought into collision-contact with the partition wall 10 of housing 7, and whereby there is an increased tendency for hammering noise to occur.

In contrast to the above, according to the control valve system of the embodiment, working-fluid pressure (hydraulic pressure) can be simultaneously supplied to both of the phase-retard chamber 11 and the phase-advance chamber 12 (see the cross section of FIG. 13 and the sixth position in the table of FIG. 18). Thus, it is possible to adequately suppress vane member 9 from fluttering and also to adequately suppress the jammed (bitten) condition of the first lock pin 26 between the first lock-pin hole 31*a* and the first lock hole 24, and the jammed (bitten) condition of the second lock pin 27 between the second lock-pin hole 31*b* and the second lock hole 25. Thereafter, when the engine operating condition has been shifted to a low-speed low-load operating range, valve spool 52 is further displaced leftward against the spring force of valve spring 53 by energizing the solenoid 54 with a further increase in electric current flowing through the electromagnetic coil 67, and thus positioned at the third position shown in FIG. 16. Both of the lock passage 28 and the phase-retard passage 18 remain kept in a fluid-communication relationship with the discharge passage 20*a*. Fluid-communication between the phase-advance passage 19 and the drain passage 22 becomes established.

As a result of this, first and second lock pins 26-27 become kept out of engagement with respective lock holes 24-25 (see FIG. 5). Also, working fluid in phase-advance chamber 12 is drained through the drain passage 22 and thus hydraulic pressure in phase-advance chamber 12 becomes low, whereas working fluid is delivered via the discharge passage 20*a* to the phase-retard chamber 11 and thus hydraulic pressure in phase-retard chamber 11 becomes high. Accordingly, vane member 9 rotates relative to the housing 7 (i.e., sprocket 1) toward the maximum phase-retard angular position (see FIG. 3).

Accordingly, a valve overlap of open periods of intake and exhaust valves becomes small and thus the amount of in-cylinder residual gas also reduces, thereby enhancing a combustion efficiency and consequently ensuring stable engine revolutions and improved fuel economy.

Thereafter, when the engine operating condition has been shifted to a high-speed high-load operating range, valve spool 52 is displaced rightward by energizing the solenoid 54 with a small amount of control current flowing through the electromagnetic coil 67, and thus positioned at the second position shown in FIG. 14. As a result, fluid-communication between the phase-retard passage 18 and the drain passage 22 becomes established. The lock passage 28 remains kept in a fluid-communication relationship with the discharge passage

20*a*. At the same time, fluid-communication between the phase-advance passage 19 and the discharge passage 20*a* becomes established.

Therefore, first and second lock pins 26-27 are kept out of engagement with respective lock holes 24-25 (see FIG. 5). Also, working fluid in phase-retard chamber 11 is drained through the drain passage 22 and thus hydraulic pressure in phase-retard chamber 11 becomes low, whereas working fluid is delivered via the discharge passage 20*a* to the phase-advance chamber 12 and thus hydraulic pressure in phase-advance chamber 12 becomes high. Accordingly, vane member 9 rotates relative to the housing 7 (i.e., sprocket 1) toward the maximum phase-advance angular position (see FIG. 4). Thus, the angular phase of camshaft 2 relative to sprocket 1 is converted into the maximum advanced relative rotation phase.

Accordingly, a valve overlap of open periods of intake and exhaust valves becomes large and thus the intake-air charging efficiency is increased, thereby improving engine torque output.

Conversely when the engine operating condition shifts from the low-speed low-load operating range or the high-speed high-load operating range to the idling condition, a supply of control current from controller 34 to the electromagnetic coil 67 of electromagnetic directional control valve 21 is stopped and thus the solenoid 54 is de-energized. Thus, valve spool 52 is positioned at the maximum rightward axial position (i.e., the first position) shown in FIG. 12 by the spring force of valve spring 53. The lock passage 28 communicates with the drain passage 22, whereas the discharge passage 20*a* communicates with both of the phase-retard passage 18 and the phase-advance passage 19. Accordingly, hydraulic pressures having almost the same pressure value are applied to respective hydraulic chambers (phase-retard chamber 11 and phase-advance chamber 12).

For the reasons discussed above, even when vane member 9 has been positioned at a phase-retard angular position, rotary motion of vane member 9 relative to sprocket 1 in the phase-advance direction occurs owing to alternating torque acting on camshaft 2. Hence, by the spring force of first spring 29 and by virtue of the ratchet action of the first lock guide stepped groove (bottom faces 24*a*-24*c*), first lock pin 26 is brought into engagement with the first, second, and third bottom faces 24*a*-24*c* of first lock hole 24, one-by-one, owing to rotary motion of vane member 9 (vane 16*a*) in the phase-advance direction. In a similar manner, by the spring force of second spring 30 and by virtue of the ratchet action of the second lock guide stepped groove (bottom faces 25*a*-25*b*), second lock pin 27 is brought into engagement with the first and second bottom faces 25*a*-25*b* of second lock hole 25, one-by-one, owing to rotary motion of vane member 9 (vane 16*b*) in the phase-advance direction. Hence, the angular position of vane member 9 relative to sprocket 1 is held or locked at the intermediate-phase angular position (see FIG. 2) between the maximum phase-retard angular position (see FIG. 3) and the maximum phase-advance angular position (see FIG. 4).

Also, when stopping the engine, the ignition switch is turned OFF. As previously described, first and second lock pins 26-27 are maintained in their locked states where the tip 26*a* of first lock pin 26 has been engaged with the third bottom face 24*c* of first lock hole 24 and the tip 27*a* of second lock pin 27 has been engaged with the second bottom face 25*b* of second lock hole 25.

Furthermore, assume that the engine is operating continuously in a given engine operating range, the electromagnetic coil 67 of solenoid 54 of electromagnetic directional control valve 21 is energized with a given amount of control current, and thus valve spool 52 is positioned at a substantially intermediate axial position, that is, the fourth position as shown in FIG. 15. In this case, fluid-communication between the first introduction port 55*a* and the third supply port 57 is blocked by the fourth land portion 63*d*, whereas fluid-communication between the first supply port 56*a* and the second drain port 59*b* is blocked by the second land portion 63*b*. As a result, fluid communication between the phase-advance passage 19 and the discharge passage 20*a* is blocked and fluid communication between the phase-retard passage 18 and the drain passage 22 is blocked. On the other hand, fluid communication between the discharge passage 20*a* and the lock passage 28 is established.

Hence, hydraulic pressure of working fluid in each of phase-retard chambers 11 and hydraulic pressure of working fluid in each of phase-advance chambers 12 are held constant. Also, by the hydraulic-pressure supply from the discharge passage 20*a* to the lock passage 28, first and second lock pins 26-27 are kept out of engagement with respective lock holes 24-25, that is, held in their unlocked states.

Therefore, the angular position of vane member 9 relative to sprocket 1 is held at a desired angular position corresponding to the given amount of control current, and thus the angular phase of camshaft 2 relative to sprocket 1 (i.e., housing 7) is held at a desired relative-rotation phase. Accordingly, intake valve open timing (IVO) and intake valve closure timing (IVC) can be held at respective desired timing values.

In this manner, by energizing the solenoid 54 of electromagnetic directional control valve 21 with a desired amount of control current or de-energizing the solenoid 54, by means of controller 34 depending on latest up-to-date information about an engine operating condition, and thus controlling axial movement of valve spool 52, the axial position of valve spool 52 can be controlled to either one of the first, second, third, and fourth positions. As discussed above, the angular phase of camshaft 2 relative to sprocket 1 (i.e., housing 7) can be adjusted or controlled to a desired relative-rotation phase (an optimal relative-rotation phase) by controlling both of the phase-change mechanism 3 and the position-hold mechanism 4, thus more certainly enhancing the control accuracy of valve timing control. By the way, as can be seen from the cross sections of FIGS. 12-17, when switching between a supply state of working fluid to an opening (a port) of directional control valve 21 and an exhaust state of working fluid from the opening (the port) by changing one of the first, second, third, and fourth positions to another, for instance, when switching from the supply state (see the arrow (the solid line) indicating supply-flow from the discharge passage 20*a* to the third supply port 57 at the second position shown in FIG. 14) to the exhaust state (see the arrow (the broken line) indicating exhaust-flow from the third port 57 to the drain passage 22 at the third position shown in FIG. 16), the port (e.g., the third port 57) is temporarily closed at the intermediate spool position (see the fourth position of FIG. 15) between the second position of FIG. 14 and the third position of FIG. 16. In other words, when switching between a supply state of working fluid to a port and an exhaust state of working fluid from the port by changing the spool position, fluid-communication between the port and each of the discharge passage 20*a* and the drain passage 22 is temporarily shut off.

Moreover, assume that the axially sliding spool 52 has been stuck due to contamination, dirt or debris (e.g., a very small piece of metal) contained in working fluid used in the hydraulic circuit 5 and jammed between the edge of each of land portions 63*a*-63*e* and the edge of each of the ports, when the engine has stopped abnormally due to an undesirable engine stall, or when restarting the engine after the engine has stopped normally. Owing to the sticking spool 52, it is difficult to achieve selective switching among the ports, that is, a change in the path of flow through the electromagnetic directional control valve 21. Under such an abnormal condition, that is, under a disabling state of sliding movement of valve spool 52, the control valve system of the embodiment operates as follows.

That is, when, due to valve spool 52 stuck, valve spool 52 is in the disabling state of sliding movement, as a matter of course, it is impossible to execute angular phase control of vane member 9. The abnormal condition (i.e., the disabling state of movement of valve spool 52) is determined by controller 34, based on a result of comparison between the actual angular phase detected by the cam angle sensor and the desired angular phase of camshaft 2, in other words, based on a time duration during which a state where a command value (a desired valve timing value) for valve timing control differs from an actually detected valve timing value continues, and its predetermined threshold time duration. When the abnormal condition has been determined by means of controller 34, controller 34 generates a maximum amount of control current to the electromagnetic coil 67 of solenoid 54 of electromagnetic directional control valve 21. As a result of this, valve spool 52 is forcibly displaced axially leftward by a maximum magnitude of electromagnetic force produced by the solenoid 54, while shearing the contamination or debris, and thus positioned at the fifth position (see FIG. 17). Hence, as seen from the longitudinal cross section of FIG. 17, all of phase-retard passage 18, phase-advance passage 19, and lock passage 28 communicate with the drain passage 22, and as a result working fluid in each of phase-retard chambers 11, working fluid in each of phase-advance chambers 12, and working fluid in each of first and second unlocking pressure-receiving chambers 32-33 are all drained into the oil pan 23.

Therefore, even when vane member 9 has been positioned at a phase-retard angular position displaced from the intermediate-phase angular position, rotary motion of vane member 9 relative to sprocket 1 in the phase-advance direction occurs owing to the negative torque of alternating torque acting on camshaft 2. As a result, by the spring force of first spring 29 and by virtue of the ratchet action of the first lock guide stepped groove, first lock pin 26 is smoothly brought into engagement with the first lock hole 24. Simultaneously, by the spring force of second spring 30 and by virtue of the ratchet action of the second lock guide stepped groove, second lock pin 27 is smoothly brought into engagement with the second lock hole 25. Accordingly, the angular phase of camshaft 2 relative to sprocket 1 (i.e., housing 7) can be held at the predetermined intermediate angular phase between the maximum retarded relative-rotation phase and the maximum advanced relative-rotation phase.

Figure 19:
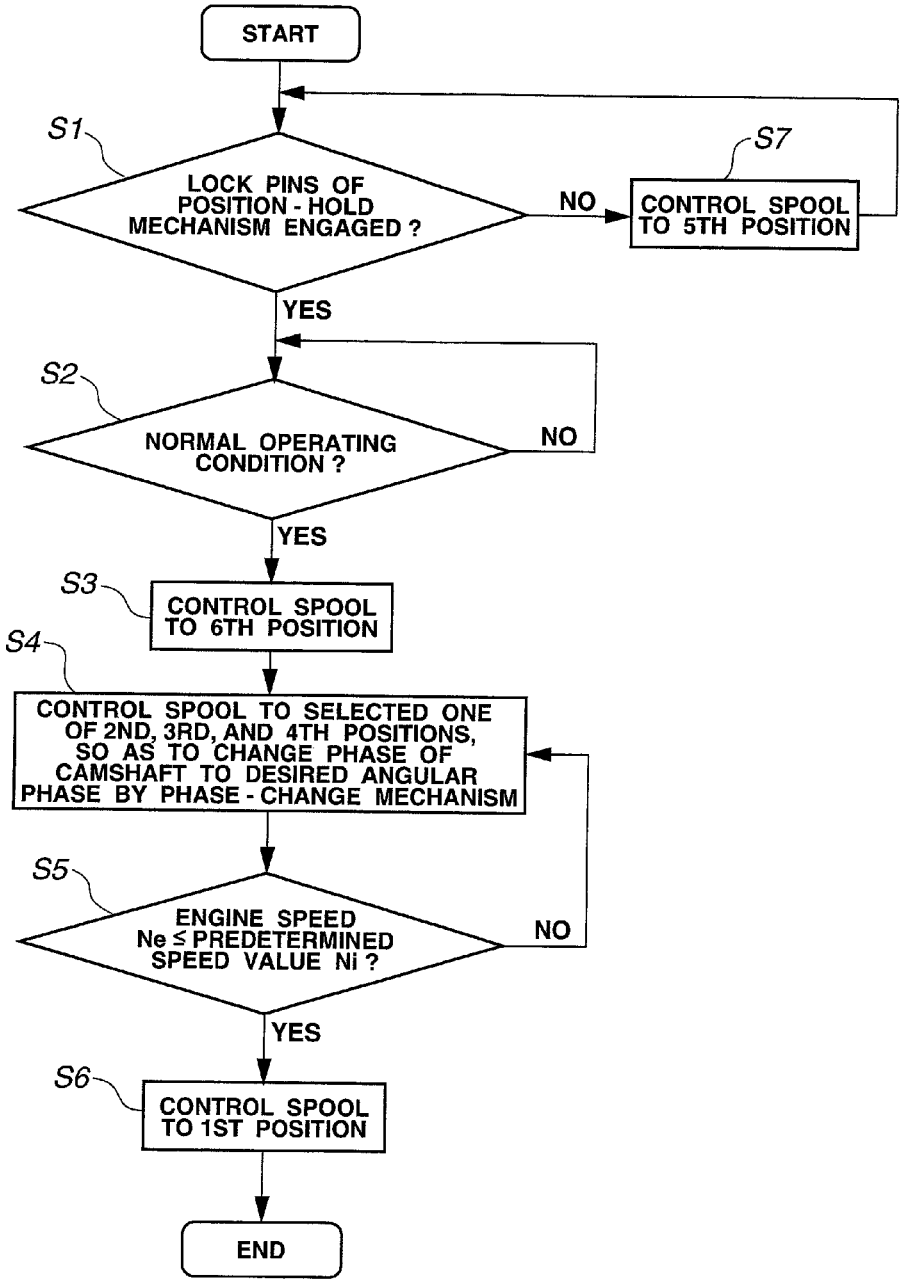
FIG. 19 is a valve-spool position control flow chart executed within an electronic control unit (a controller) incorporated in the VTC system.

Referring now to FIG. 19, there is shown the position control flow of valve spool 52 of electromagnetic directional control valve 21, executed within the controller 34. The control routine of FIG. 19 is executed as time-triggered interrupt routines to be triggered every predetermined sampling time intervals.

At step S1, a check is made to determine whether position-hold mechanism 4 is in the locked (engaged) state of lock pins 26-27 with respective lock holes 24-25. For instance, when the engine is in its stopped state, position-hold mechanism 4 is kept in the locked (engaged) state. When the answer to step S1 is in the affirmative (YES), the routine proceeds to step S2.

At step S2, a check is made to determine whether the engine becomes shifted to a normal operating condition. When the answer to step S2 is in the negative (NO), the routine returns to step S2. Conversely when the answer to step S2 is in the affirmative (YES), the routine proceeds to step S3.

At step S3, the axial position of valve spool 52 is controlled to the sixth position (see FIG. 13), such that all of phase-retard passage 18, phase-advance passage 19, and lock passage 28 communicate with the discharge passage 20*a*. Thereafter, step S4 occurs.

At step S4, the axial position of valve spool 52 is controlled to a selected one of the second, third, and fourth positions, determined based on latest up-to-date information about an engine operating condition, and thus the angular phase of camshaft 2 relative to sprocket 1 is controlled to and held at a desired angular phase by means of phase-change mechanism 3.

At step S5, a check is made to determine whether engine speed Ne becomes less than or equal to a predetermined engine speed value Ni, that is, Ne≤Ni. When the answer to step S5 is in the negative (NO), the routine returns to step S4. Conversely when the answer to step S5 is in the affirmative (YES), the routine proceeds to step S6.

At step S6, the axial position of valve spool 52 is controlled to the first position (see FIG. 12). In this manner, one execution cycle of valve-spool position control terminates.

Returning to step S1, conversely when the answer to step S1 is in the negative (NO), that is, when position-hold mechanism 4 is in the unlocked (disengaged) state of lock pins 26-27 from respective lock holes 24-25, the routine advances from step S1 to step S7.

At step S7, controller 34 generates a maximum amount of control current to the electromagnetic coil 67 of solenoid 54 of electromagnetic directional control valve 21, and then valve spool 52 is forcibly displaced axially leftward by a maximum magnitude of electromagnetic force produced by the solenoid 54, and thus positioned at the fifth position (see the cross section of FIG. 17). As a result, all of phase-retard passage 18, phase-advance passage 19, and lock passage 28 communicate with the drain passage 22, so as to permit working fluid in each of phase-retard chambers 11, working fluid in each of phase-advance chambers 12, and working fluid in each of first and second unlocking pressure-receiving chambers 32-33 to be drained into the oil pan 23.

As appreciated from the above, in preparing for movement of first and second lock pins 26-27 out of engagement with respective lock holes 24-25, the control valve system of the embodiment is configured to control valve spool 52 to the first position (the spring-loaded position) shown in FIG. 12, for exhausting working fluid in first and second unlocking pressure-receiving chambers 32-33, and simultaneously for supplying working fluid from the discharge passage 20*a* to both the hydraulic chambers 11 and 12. Hence, with the valve spool 52 positioned at the first position, hydraulic pressures having almost the same pressure value are applied to respective hydraulic chambers (phase-retard chamber 11 and phase-advance chamber 12). Thus, it is possible to suppress vane member 9 from undesirably fluttering, and also to suppress rotary motion of vane member 9 relative to sprocket 1 in a rotation direction.

Subsequently, valve spool 52 is displaced from the first position to the sixth position shown in FIG. 13, and thus working fluid is also supplied to each of first and second unlocking pressure-receiving chambers 32-33, while maintaining working-fluid supply to both the hydraulic chambers 11 and 12. Hence, it is possible to easily smoothly unlock (disengage) first and second lock pins 26-27 from respective lock holes 24-25, with a less shearing force, which may be applied to each of lock pins 26-27.

Additionally, in the embodiment, a function of hydraulic-pressure control for each of the hydraulic pressure chambers (phase-retard chamber 11 and phase-advance chamber 12) and a function of hydraulic-pressure control for each of first and second unlocking pressure-receiving chambers 32-33 are both achieved by means of the single electromagnetic directional control valve 21. Thus, it is possible to enhance the flexibility of layout of the VTC system on the engine body, thus ensuring lower system installation time and costs.

Furthermore, it is possible to enhance the ability to hold the angular position of vane member 9 relative to sprocket 1 at the intermediate-phase angular position by means of the position-hold mechanism 4. Additionally, by virtue of the first lock guide groove (the three-stage stepped lock guide groove with three bottom faces 24*a*-24*c*, serving as a one-way clutch, in other words, a ratchet) and the second lock guide groove (the two-stage stepped lock guide groove with two bottom faces 25*a*-25*b*, serving as a one-way clutch, in other words, a ratchet), movement of first lock pin 26 only into engagement with the first lock hole 24 and movement of second lock pin 27 only into engagement with the second lock hole 25 are permitted, thus assuring more safe and certain guiding action for movement of lock pins 26-27 into engagement.

Hydraulic pressure in each of phase-retard chamber 11 and phase-advance chamber 12 is not used as hydraulic pressure acting on each of first and second unlocking pressure-receiving chambers 32-33. In comparison with a system that hydraulic pressure in each of phase-retard chamber 11 and phase-advance chamber 12 is also used as hydraulic pressure acting on each of unlocking pressure-receiving chambers 32-33, a responsiveness of the hydraulic system of the embodiment to hydraulic pressure supply to each of unlocking pressure-receiving chambers 32-33 can be greatly improved. Thus, it is possible to improve a responsiveness of each of lock pins 26-27 to backward movement for unlocking (disengaging). Also, the hydraulic system of the embodiment, in which hydraulic pressure can be supplied to each of unlocking pressure-receiving chambers 32-33 without using hydraulic pressure in each of phase-retard chamber 11 and phase-advance chamber 12, more concretely, the single electromagnetic directional control valve 21 eliminates the need for a fluid-tight sealing device between each of phase-retard chamber 11 and phase-advance chamber 12 and each of unlocking pressure-receiving chambers 32-33.

Furthermore, in the shown embodiment, to ensure a smooth sliding motion of each of lock pins 26-27, first lock pin 26 is configured so that two axial ends communicate with the phase-advance chamber 12 via the respective oil holes 45*a*-45*b* and that the same hydraulic pressure in phase-advance chamber 12 simultaneously acts on both ends of first lock pin 26 and thus the hydraulic pressures acting on the two axial ends of first lock pin 45 are balanced to each other in the axial direction. In a similar manner, second lock pin 27 is configured so that two axial ends communicate with the phase-advance chamber 12 via the respective oil holes 46*a*-46*b* and that the same hydraulic pressure in phase-advance chamber 12 simultaneously acts on both ends of second lock pin 27 and thus the hydraulic pressures acting on the two axial ends of second lock pin 27 are balanced to each other in the axial direction. Hence, a smooth sliding motion of first lock pin 26 can be attained by the differential pressure between the spring force of spring 29 and the hydraulic pressure supplied to the first unlocking pressure-receiving chamber 32. In a similar manner, a smooth sliding motion of second lock pin 27 can be attained by the differential pressure between the spring force of spring 30 and the hydraulic pressure supplied to the second unlocking pressure-receiving chamber 33.

By the way, breather 43, via which the interior space facing the opposite annular upper end face (viewing FIGS. 5-10) of the first pressure-receiving portion 26*c*, spaced apart from the first pressure-receiving surface 26*e*, is opened to the atmosphere, is formed in the vane 16*a* and front cover 13 without any fluid-communication with the phase-advance chamber 12. Also, breather 44, via which the interior space facing the opposite annular upper end face (viewing FIGS. 5-10) of the second pressure-receiving portion 27*c*, spaced apart from the second pressure-receiving surface 27*e*, is opened to the atmosphere, is formed in the vane 16*b* and front cover 13 without any fluid-communication with the phase-advance chamber 12. Thus, there is no leakage of working fluid from each of breathers 43-44.

As previously discussed, in the shown embodiment, hydraulic pressure in phase-advance chamber 12 is supplied to both axial ends of each of lock pins 26-27, thereby ensuring a stable behavior (a smooth but stable sliding motion) of each of lock pins 26-27. Conversely suppose that hydraulic pressure in phase-retard chamber 11 is supplied to both ends of each of lock pins 26-27, during a starting period of the engine, in which air may be mixed with working fluid supplied to phase-retard chamber 11. In such a case, due to air mixed with the working fluid, there is an increased tendency for the behavior of each of lock pins 26-27 to become unstable and thus there is an increased tendency for hammering noise to occur.

In contrast, during steady-state operation after the engine start up, there is a less amount of air mixed with working fluid supplied to phase-advance chamber 12. Hence, due to the less air mixed with the working fluid, the behavior of each of lock pins 26-27 can be stabilized, thereby suppressing hammering noise from occurring.

Moreover, regarding the second lock guide groove, the height of the bottom step of first and second bottom faces 25*a*-25*b* of the second lock guide groove is dimensioned to be greater than that of the upper step, thus ensuring the relatively increased mechanical strength of the stepped portion near the upstanding stepped inner face 25*c*, constructing part of the second lock hole 25. Even when the outer periphery (the edge) of the tip 27*a* of second lock pin 27, which can be brought into engagement with the second lock hole 25, is repeatedly abutted with the upstanding stepped inner face 25*c* of the second lock guide groove (second lock hole 25), position-hold mechanism 4 (specially, the second lock pin 27 and the second lock guide groove) of the embodiment ensures a high durability.

Also, regarding the first lock guide groove, when first lock pin 26 is brought into engagement with the first lock hole 24, the outer periphery (the edge) of the tip 26*a* of first lock pin 26 is brought into abutted-engagement with the comparatively wider, upstanding inner face 24*d* vertically extending from the deepest bottom face (i.e., the third bottom face 24*c*). Thus, position-hold mechanism 4 (specially, the first lock pin 26 and the first lock guide groove) of the embodiment ensures a high durability.

In addition to the above, in the shown embodiment, position-hold mechanism 4 is comprised of two separate lock devices, that is, (i) the first lock pin 26 and the first lock guide groove (the three-stage stepped groove) with first to third bottom faces 24*a*-24*c* and (ii) the second lock pin 27 and the second lock guide groove (the two-stage stepped groove) with first to second bottom faces 25*a*-25*b*. Hence, it is possible to reduce the wall thickness of sprocket 1 in which each of lock holes 24-25 is formed. In more detail, for instance assuming that the position-hold mechanism is constructed by a single lock pin and a single lock guide groove (a single multi-stage stepped groove). In such a case, five bottom faces have to be formed in the sprocket in a manner so as to continuously lower stepwise from the phase-retard side (in other words, the side of phase-advance chamber 12) to the phase-advance side (in other words, the side of phase-retard chamber 11). As a matter of course, to provide the five-stage stepped groove, the wall thickness of the sprocket also has to be increased. In contrast, the embodiment adopts two separate lock devices (26, 24*a*-24*c*; 27, 25*a*-25*b*) as the position-hold mechanism, and hence it is possible to reduce the thickness of sprocket 1, thereby shortening the axial length of the VTC apparatus and consequently enhancing the flexibility of layout of the VTC system on the engine body.

Furthermore, each of first and second lock pins 26-27 is formed as a substantially cylindrical locking member, and also each of first and second pressure-receiving portions 26*c*-27*c* is formed as a simple flanged portion. This contributes to easy manufacturing process and reduced manufacturing costs.

[Second Embodiment]

Figure 20B:
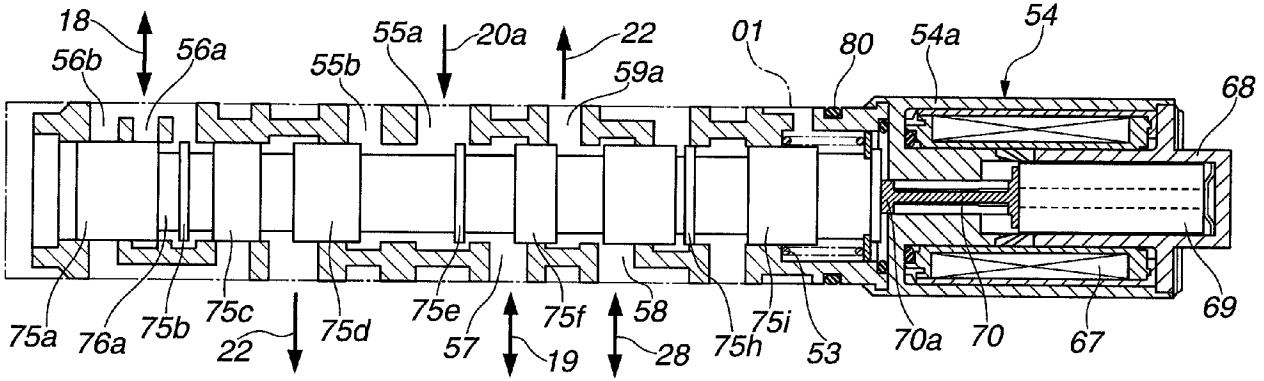

Referring now to FIGS. 20A-20B, there are shown the longitudinal cross sections of the electromagnetic directional control valve of the second embodiment. FIG. 20B shows the longitudinal cross section of the directional control valve of the second embodiment at an angular position rotated 90 degrees from the angular position corresponding to the cross section of FIG. 20A. As appreciated from comparison between the longitudinal cross section of FIG. 11 (the first embodiment) and the longitudinal cross section of FIG. 20A (the second embodiment), the control valves of the first and second embodiments somewhat differ from each other, in that, in the second embodiment, passage grooves are formed in the outer peripheral surface of valve body 51 (the valve housing) instead of forming a passage hole 60 in the valve spool 52.

That is, in the same manner as the first embodiment, in the second embodiment, as seen in FIG. 20A, valve body 51 has first and second introduction ports 55*a*-55*b* configured to communicate with the discharge passage 20*a*, first and second supply ports 56*a*-56*b* configured to communicate with the phase-retard passage 18, and third supply port 57 configured to communicate with the phase-advance passage 19. Valve body 51 has lock port 58 configured to communicate with the lock passage 28 (see FIG. 20B). Also, valve body 51 has first and second drain ports 59*a*-59*b* arranged on both sides of first and second introduction ports 55*a*-55*b*, and configured to communicate with the drain passage 22 (see FIGS. 20A-20B).

Valve body 51 has an axially-extending first passage groove 72 formed in its outer peripheral wall surface between the first supply port 56*a* and the second introduction port 55*b*, and configured to permit the second introduction port 55*b* to appropriately communicate with the first supply port 56*a* depending on a given axial position of valve spool 52. Additionally, valve body 51 has a first sub-port 73*a* formed in its outer peripheral wall surface and arranged on the right-hand side (viewing FIG. 20A) of first supply port 56*a*, and configured to communicate with the first passage groove 72. Valve body 51 has a second sub-port 73*b* (a through hole) arranged on the side of electromagnetic solenoid 54 and configured to appropriately communicate with the lock port 58 depending on a given axial position of valve spool 52. Also, valve body 51 has an axially-extending second passage groove 74 formed in its outer peripheral wall surface between the second sub-port 73*b* and the first introduction port 55*a*, and configured to permit the first introduction port 55*a* to always communicate with the second sub-port 73*b*. Furthermore, valve body 51 has a substantially annular third passage groove 77 formed in its outer peripheral wall diametrically opposed to the first supply port 56*a* and the first sub-port 73*a*.

By the way, each of the first passage groove 72, the second passage groove 74, and the third passage groove 77 of valve body 51 cooperates with the inner peripheral surface of valve accommodation bore 01 of the engine cylinder block, to define the three fluid-flow passages.

On the other hand, in the second embodiment, as seen in FIGS. 20A-20B, valve spool 52 is formed as a substantially cylindrical solid spool having a solid cross section. Valve spool 52 has axially-spaced nine land portions, that is, first, second, third, fourth, fifth, sixth, seventh, eighth, and ninth land portions 75*a*, 75*b*, 75*c*, 75*d*, 75*e*, 75*f*, 75*g*, 75*h*, and 75*i*, formed or machined on the outer peripheral surface of valve spool 52 and arranged in that order in the left-to-right direction. Nine annular passage grooves 76*a*-76*i* between the lands 75*a*-75*i* are defined to provide the flow passages between ports. The axial dimensions of land portions 75*a*-75*i*, in other words, the axial lengths of annular grooves 76*a*-76*i* differ from each other depending on the positions of formation of the ports. First, second, third, fourth, fifth, sixth, seventh, eighth, and ninth annular grooves 76*a*, 76*b*, 76*c*, 76*d*, 76*e*, 76*f*, 76*g*, 76*h*, and 76*i* are arranged in that order in the left-to-right direction.

[Position Control of Valve Spool]

Position control of valve spool 52 of electromagnetic directional control valve 21 of the second embodiment is hereunder described in detail by reference to the table of FIG. 18 showing the relationship between the stroke amount (the axial position) of valve spool 52 and the working-fluid supply/exhaust to and from each of phase-retard passage 18 (phase-retard chambers 11), phase-advance passage 19 (phase-advance chambers 12), and lock passage 28 (first and second unlocking pressure-receiving chambers 32-33) and the cross sections of FIGS. 21A-21B, 22A-22B, 23A-23B, 24A-24B, 25A-25B, and 26A-26B, respectively showing the first position, the sixth position, the second position, the fourth position, the third position, and the fifth position of valve spool 52.

First of all, as shown in FIGS. 20A-20B and 21A-21B, when valve spool 52 is positioned at the maximum rightward axial position (i.e., the first position) by the spring force of valve spring 53, fluid-communication between the second introduction port 55*b* and the first supply port 56*a* through the first passage groove 72, the first sub-port 73*a* and the first annular passage groove 76*a* is established, and fluid-communication between the first introduction port 55*a* and the third supply port 57 through the fifth annular passage groove 76*e* is established. Simultaneously, fluid-communication between the lock port 58 and the first drain port 59*a* through the sixth annular passage groove 76*f* is established (see FIG. 21B).

Secondly, as shown in FIGS. 22A-22B, when valve spool 52 has been slightly displaced leftward from the maximum rightward axial position (i.e., the first position) against the spring force of valve spring 53 by energizing the electromagnetic coil 67 of solenoid 54, and thus positioned at the sixth position, on the one hand, fluid-communication between the second introduction port 55*b* and the first supply port 56*a* and fluid-communication between the first introduction port 55*a* and the third supply port 57 remain unchanged. On the other hand, fluid-communication between the lock port 58 and the first drain port 59*a* becomes blocked, but fluid-communication between the first introduction port 55*a* and the lock port 58 through the second passage groove 74 and the second sub-port 73*b*, and the eighth annular passage groove 76*h* becomes established.

Thirdly, as shown in FIGS. 23A-23B, when valve spool 52 has been further displaced leftward from the sixth position by energizing the solenoid 54 with an increase in electric current flowing through the electromagnetic coil 67, and thus positioned at the second position, fluid-communication between the first introduction port 55*a* and the third supply port 57 and fluid-communication between the first introduction port 55*a* and the lock port 58 remain unchanged. Fluid-communication between the second introduction port 55*b* and the first supply port 56*a* becomes blocked. Fluid-communication between the second supply port 56*b* and the second drain port 59*b* through the third passage groove 77 and the third annular passage groove 76*c* becomes established.

Fourthly, as shown in FIGS. 24A-24B, when valve spool 52 has been further displaced leftward from the second position by energizing the solenoid 54 with a further increase in electric current flowing through the electromagnetic coil 67, and thus positioned at the fourth position, fluid-communication between the first introduction port 55*a* and the third supply port 57 and fluid-communication between the first introduction port 55*a* and the lock port 58 remain unchanged. Fluid-communication between the second supply port 56*b* and the second drain port 59*b* becomes blocked.

Fifthly, as shown in FIGS. 25A-25B, when valve spool 52 has been further displaced leftward from the fourth position by energizing the solenoid 54 with a still further increase in electric current flowing through the electromagnetic coil 67, and thus positioned at the third position, fluid-communication between the first introduction port 55*a* and the lock port 58 remains unchanged. Simultaneously, fluid-communication between the first introduction port 55*a* and the first supply port 56*a* through the second introduction port 55*b*, the first passage groove 72, the first sub-port 73*a*, and the second annular passage groove 76*b*, and fluid-communication between the third supply port 57 and the first drain port 59*a* through sixth annular passage groove 76*f* become established.

Sixthly, as shown in FIGS. 26A-26B, when valve spool 52 has been further displaced leftward from the third position by energizing the solenoid 54 with a maximum amount of electric current flowing through the electromagnetic coil 67, and thus positioned at the fifth position, the first supply port 56*a* communicates with the second drain port 59*b* through the first annular passage groove 76*a* and the third passage groove 77. Simultaneously, the lock port 58 and the third supply port 57 both communicate with the first drain port 59*a*.

As discussed above, in a similar manner to the first embodiment, electromagnetic directional control valve 21 of the second embodiment is configured to change the path of flow through the directional control valve by selective switching among the ports depending on a given axial position of valve spool 52, determined based on latest up-to-date information about an engine operating condition, thereby changing a relative angular phase of vane member 9 (camshaft 2) to sprocket 1 (the crankshaft) and also enabling selective switching between locked and unlocked states of position-hold mechanism 4, in other words, selective switching between a locked (engaged) state of lock pins 26-27 with respective lock holes 24-25 and an unlocked (disengaged) state of lock pins 26-27 from respective lock holes 24-25. Accordingly, by means of electromagnetic directional control valve 21 of the second embodiment as previously discussed, free rotation of vane member 9 relative to sprocket 1 can be enabled (permitted) or disabled (restricted) depending on the engine operating condition. Furthermore, when the abnormal condition (i.e., the disabling state of movement of valve spool 52), for example, the sticking valve spool due to contamination and debris, is determined by controller 34, valve spool 52 is forcibly displaced axially toward the maximum solenoid-operated position, i.e., the fifth position (see FIGS. 26A-26B) by a maximum magnitude of electromagnetic force produced by the solenoid 54. By virtue of the forcible axially-leftward movement of valve spool 52, the contamination, dirt or debris jammed between the edge of each of land portions 63*a*-63*e* and the edge of each of the ports can be cut, thus enabling axial sliding movement of valve spool 52.

Except for the fluid-passage structure, the basic construction and operation of the control valve system of the second embodiment is identical to those of the first embodiment. Thus, the control valve system of the second embodiment can provide the same operation and effects as the first embodiment, concretely, the greatly improved responsiveness of each of lock pins 26-27 to backward movement for unlocking (disengaging), in other words, smooth and easy unlocking action of lock pins 26-27 from respective lock holes 24-25, and stable behavior (smooth but stable sliding motion) of each of lock pins 26-27.

It will be appreciated that the invention is not limited to the particular embodiments shown and described herein, but that various changes and modifications may be made. Electromagnetic directional control valve 21 of the shown embodiment is exemplified in the VTC apparatus applied to an intake-valve side of an internal combustion engine. In lieu thereof, electromagnetic directional control valve 21 may be used for a VTC apparatus installed on an exhaust-valve side.

Moreover, in the directional control valve of the first embodiment, at the fourth position, the discharge passage 20*a* communicates with the lock passage 28 and simultaneously fluid-communication between the discharge passage 20*a* and each of phase-advance passage 19 and phase-retard passage 18 is blocked. In lieu thereof, at the fourth position, in addition to fluid-communication between the discharge passage 20*a* and the lock passage 28, at the same time the discharge passage 20*a* may communicate with both the phase-advance passage 19 and the phase-retard passage 18 through a very small flow passage area less than a given flow passage area obtained at the first position.

Additionally, in the first and second embodiments, to realize the first and sixth positions, needed for smooth unlocking action, the directional control valve structure requires a pair of supply ports 56*a*-56*b* arranged adjacent to each other. During a transition from the first position (see FIG. 12) to the sixth position (see FIG. 13) for smooth unlocking action of the lock mechanism, in other words, under a first supply state, the opening of first supply port 56*a* is kept open for functioning as a hydraulic-pressure supply port for phase-retard passage 18, whereas the opening of second supply port 56*b* is closed (shut off). In lieu thereof, under the first supply state where the opening of first supply port 56*a* is kept open for hydraulic-pressure supply to phase-retard passage 18, the opening of second supply port 56*b* may be throttled to a small flow passage area. In contrast, during phase-change control (for instance, see the third position of FIG. 16 in a low-speed low-load range) after the smooth unlocking action has been completed, in other words, under a second supply state, the opening of first supply port 56*a* is closed (shut off), whereas the opening of second supply port 56*b* is kept open. In lieu thereof, under the second supply state where the opening of second supply port 56*b* is kept open for hydraulic-pressure supply to phase-retard passage 18, the opening of first supply port 56*a* may be throttled to a small flow passage area. As discussed above, in the shown embodiments, the adjacent-supply-port-pair equipped directional control valve is configured so that switching between the first and second supply states occurs depending on the spool axial position, that is, by sliding movement of valve spool 52.

Also, in the shown embodiments, the adjacent first and second supply ports 56*a*-56*b* are configured to communicate with the phase-retard chamber 18, whereas the third supply port 57 is configured to communicate with the phase-advance chamber 19. In lieu thereof, the supply port structure may be configured so that the adjacent first and second supply ports 56*a*-56*b* communicate with the phase-advance chamber 19, whereas the third supply port 57 communicates with the phase-retard chamber 18. In such a case, in the table of FIG. 18, the second position and the third position are replaced with each other.

The entire contents of Japanese Patent Application No. 2011-151320 (filed Jul. 8, 2011) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A control valve for use in a valve timing control apparatus having a housing adapted to be driven by a crankshaft of an internal combustion engine and configured to define a working fluid chamber therein, a vane rotor fixedly connected to a camshaft and rotatably accommodated in the housing so that the vane rotor rotates relative to the housing, the vane rotor having vanes configured to partition the working fluid chamber into a phase-advance chamber and a phase-retard chamber, a lock mechanism configured to be locked to enable the vane rotor to be held at an intermediate position between a maximum phase-advance position and a maximum phase-retard position, and configured to be unlocked by a working fluid pressure supplied thereto, a phase-advance passage configured to communicate with the phase-advance chamber, a phase-retard passage configured to communicate with the phase-retard chamber, and a lock passage provided for working-fluid-pressure supply-and-exhaust for the lock mechanism, comprising:

a directional control valve configured to be switchable among a first position, a second position, a third position, and a fourth position, the first position being a position at which a discharge passage of a pump driven by the engine communicates with both the phase-advance passage and the phase-retard passage and simultaneously the lock passage communicates with a drain passage, the second position being a position at which the discharge passage communicates with both the phase-advance passage and the lock passage and simultaneously the phase-retard passage communicates with the drain passage, the third position being a position at which the discharge passage communicates with both the phase-retard passage and the lock passage and simultaneously the phase-advance passage communicates with the drain passage, and the fourth position being a position at which the discharge passage communicates with the lock passage and simultaneously the discharge passage communicates with both the phase-advance passage and the phase-retard passage through a flow passage area less than a given flow passage area obtained at the first position or fluid-communication between the discharge passage and each of the phase-advance passage and the phase-retard passage is blocked.

2. The control valve as claimed in claim 1, wherein:

the directional control valve is further configured to be switchable to a fifth position at which the phase-advance passage, the phase-retard passage, and the lock passage all communicate with the drain passage.

3. The control valve as claimed in claim 1, wherein:

the directional control valve is further configured to be switchable to a sixth position at which the phase-advance passage, the phase-retard passage, and the lock passage all communicate with the discharge passage.

4. The control valve as claimed in claim 1, wherein:

the directional control valve comprising:

a substantially cylindrical-hollow valve body having a plurality of ports formed in a manner so as to penetrate inner and outer peripheries of the valve body;

an axially-sliding spool installed in the valve body and configured to have a plurality of land portions for changing an opening area of each of the ports depending on a given position of the spool axially displaced relative to the valve body and a plurality of annular grooves defined between the land portions;

a biasing member for biasing the spool in one of two axial directions; and an electromagnetic solenoid for moving the spool in the opposite axial direction by energizing the solenoid.

5. The control valve as claimed in claim 4, wherein:

the ports of the valve body include a first supply port and a second supply port arranged adjacent to each other, the first and second supply ports configured to communicate with either one of the phase-advance passage and the phase-retard passage, a third supply port configured to communicate with the other of the phase-advance passage and the phase-retard passage, a lock port configured to communicate with the lock passage, an introduction port configured to communicate with the discharge passage, and a drain port configured to communicate with the drain passage, and the land portions of the spool respectively configured to substantially correspond to axial positions of formation of the ports of the valve body.

6. The control valve as claimed in claim 5, wherein:

the directional control valve is configured to provide a first supply state where an opening of the first supply port is kept open and an opening of the second supply port is throttled or closed, and further configured to provide a second supply state where the opening of the second supply port is kept open and the opening of the first supply port is throttled or closed, and switching between the first and second supply states occurs by sliding movement of the spool.

7. The control valve as claimed in claim 6, wherein:

the directional control valve is placed into the second supply state at either one of the second and third positions, when the first position corresponds to the first supply state.

8. The control valve as claimed in claim 5, wherein:

the spool comprises a substantially cylindrical-hollow member having a central axially-extending passage hole and a plurality of communication holes formed in a manner so as to penetrate inner and outer peripheries of the spool and respectively communicating with specified annular grooves of the annular grooves defined between the land portions, the spool being configured to establish fluid-communication between at least two grooves of the specified annular grooves through the passage hole depending on the given position of the spool.

9. The control valve as claimed in claim 4, wherein:

the directional control valve is configured to return the spool to the first position by a force of the biasing member, when the electromagnetic solenoid is de-energized.

10. The control valve as claimed in claim 9, wherein:

the directional control valve is configured to switch from the second position through the fourth position to the third position, in that order, as an amount of electric current flowing through the electromagnetic solenoid increases.

11. The control valve as claimed in claim 10, wherein:

the directional control valve is further configured to be switchable to a fifth position at which the phase-advance passage, the phase-retard passage, and the lock passage all communicate with the drain passage; and the directional control valve is still further configured to switch from the second position through the fourth and third positions to the fifth position, in that order, as the amount of electric current flowing through the electromagnetic solenoid increases.

12. The control valve as claimed in claim 10, wherein:

the directional control valve is further configured to be switchable to a sixth position at which the phase-advance passage, the phase-retard passage, and the lock passage all communicate with the discharge passage; and the directional control valve is still further configured to switch from the sixth position through the second and fourth positions to the third position, in that order, as the amount of electric current flowing through the electromagnetic solenoid increases.

13. The control valve as claimed in claim 1, wherein:

fluid-communication between an opening of the directional control valve and each of the discharge passage and the drain passage is temporarily shut off, when switching between a supply state of working fluid to the opening and an exhaust state of working fluid from the opening by changing one of the first, second, third, and fourth positions to another.

14. A control valve for use in a valve timing control apparatus having a driving rotary member adapted to be driven by a crankshaft of an internal combustion engine, a driven rotary member fixedly connected to a camshaft and configured to define a phase-advance chamber and a phase-retard chamber between the driving rotary member and the driven rotary member, a lock mechanism configured to be locked to enable an angular position of the driven rotary member relative to the driving rotary member to be held at an intermediate position between a maximum phase-advance position and a maximum phase-retard position, and configured to be unlocked by a working fluid pressure supplied thereto, a phase-advance passage configured to communicate with the phase-advance chamber, a phase-retard passage configured to communicate with the phase-retard chamber, and a lock passage provided for working-fluid-pressure supply-and-exhaust for the lock mechanism, comprising:

a directional control valve configured to be switchable among a first position, a second position, a third position, and a fourth position, the first position being a position at which a discharge passage of a pump driven by the engine communicates with both the phase-advance passage and the phase-retard passage and simultaneously the lock passage communicates with a drain passage, the second position being a position at which the discharge passage communicates with both the phase-advance passage and the lock passage and simultaneously the phase-retard passage communicates with the drain passage, the third position being a position at which the discharge passage communicates with both the phase-retard passage and the lock passage and simultaneously the phase-advance passage communicates with the drain passage, and the fourth position being a position at which the discharge passage communicates with the lock passage and simultaneously the discharge passage communicates with both the phase-advance passage and the phase-retard passage through a flow passage area less than a given flow passage area obtained at the first position or fluid-communication between the discharge passage and each of the phase-advance passage and the phase-retard passage is blocked.

15. A controller for controlling a control valve for use in a valve timing control apparatus having a housing adapted to be driven by a crankshaft of an internal combustion engine and configured to define a working fluid chamber therein, a vane rotor fixedly connected to a camshaft and rotatably accommodated in the housing so that the vane rotor rotates relative to the housing, the vane rotor having vanes configured to partition the working fluid chamber into a phase-advance chamber and a phase-retard chamber, a lock mechanism configured to be locked to enable the vane rotor to be held at an intermediate position between a maximum phase-advance position and a maximum phase-retard position, and configured to be unlocked by a working fluid pressure supplied thereto, a phase-advance passage configured to communicate with the phase-advance chamber, a phase-retard passage configured to communicate with the phase-retard chamber, and a lock passage provided for working-fluid-pressure supply-and-exhaust for the lock mechanism, comprising:

an electronic control unit configured to control switching among a first position, a second position, a third position, and a fourth position by varying a level of energizing an electrically-actuated valve element of the control valve, the first position being a position at which a discharge passage of a pump driven by the engine communicates with both the phase-advance passage and the phase-retard passage and simultaneously the lock passage communicates with a drain passage, the second position being a position at which the discharge passage communicates with both the phase-advance passage and the lock passage and simultaneously the phase-retard passage communicates with the drain passage, the third position being a position at which the discharge passage communicates with both the phase-retard passage and the lock passage and simultaneously the phase-advance passage communicates with the drain passage, and the fourth position being a position at which the discharge passage communicates with the lock passage and simultaneously the discharge passage communicates with both the phase-advance passage and the phase-retard passage through a flow passage area less than a given flow passage area obtained at the first position or fluid-communication between the discharge passage and each of the phase-advance passage and the phase-retard passage is blocked;

the control unit configured to switch the control valve to the first position during a starting period of the engine;

the control unit configured to selectively switch the control valve to either one of the second and third positions, when varying valve timing of the engine; and the control unit configured to switch the control valve to the fourth position, when holding the valve timing of the engine.

16. The controller as claimed in claim 15, wherein:

the control valve is further configured to be switchable to a fifth position at which the phase-advance passage, the phase-retard passage, and the lock passage all communicate with the drain passage;

the control unit is configured to switch the control valve to the fifth position, when a state where a command value for valve timing control differs from an actually detected valve timing value continues.

17. The controller as claimed in claim 16, wherein:

the control valve comprising:

a substantially cylindrical-hollow valve body having a plurality of ports formed in a manner so as to penetrate inner and outer peripheries of the valve body;

an axially-sliding spool installed in the valve body and configured to have a plurality of land portions for changing an opening area of each of the ports depending on a given position of the spool axially displaced relative to the valve body and a plurality of annular grooves defined between the land portions;

a biasing member for biasing the spool in one of two axial directions; and an electromagnetic solenoid for moving the spool in the opposite axial direction by energizing the solenoid, wherein the fifth position is an electrically-actuated position corresponding to a maximum displacement of the spool displaced in the opposite axial direction by energizing the solenoid.

18. The controller as claimed in claim 17, wherein:

the control valve is further configured to be switchable to a sixth position at which the phase-advance passage, the phase-retard passage, and the lock passage all communicate with the discharge passage;

the control unit is configured to switch the control valve to the sixth position, after initial explosion of the engine has occurred during the starting period of the engine but before an output of the command value for valve timing control.

19. The controller as claimed in claim 18, wherein:

the control valve comprising:

a substantially cylindrical-hollow valve body having a plurality of ports formed in a manner so as to penetrate inner and outer peripheries of the valve body;

an axially-sliding spool installed in the valve body and configured to have a plurality of land portions for changing an opening area of each of the ports depending on a given position of the spool axially displaced relative to the valve body and a plurality of annular grooves defined between the land portions;

a biasing member for biasing the spool in one of two axial directions; and an electromagnetic solenoid for moving the spool in the opposite axial direction by energizing the solenoid, wherein the sixth position is an electrically-actuated position to which the control valve is switchable by energizing the solenoid with a smaller amount of electric current flowing through the solenoid as compared with the second, third, and fourth positions.

* * * * *